US010872591B2

(12) United States Patent
Betz et al.

(10) Patent No.: US 10,872,591 B2
(45) Date of Patent: Dec. 22, 2020

(54) COMPENSATION MEANS FOR A LOUDSPEAKER SYSTEM AND LOUDSPEAKER SYSTEM

(71) Applicant: Fraunhofer-Gesellschaft zur Foerderung der angewandten Forschung e.V., Munich (DE)

(72) Inventors: Lorenz Betz, Wassertruedingen (DE); Maximilian Wolf, Vilsheim (DE)

(73) Assignee: FRAUNHOFER-GESELLSCHAFT ZUR FOERDERUNG DER ANGEWANDTEN FORSCHUNG E.V., Munich (DE)

( * ) Notice: Subject to any disclaimer, the term of this patent is extended or adjusted under 35 U.S.C. 154(b) by 34 days.

(21) Appl. No.: 16/246,088

(22) Filed: Jan. 11, 2019

(65) Prior Publication Data

US 2019/0147844 A1 May 16, 2019

Related U.S. Application Data

(63) Continuation of application No. PCT/EP2017/067603, filed on Jul. 12, 2017.

(30) Foreign Application Priority Data

Jul. 13, 2016 (DE) ..... 10 2016 212 828
Jan. 13, 2017 (DE) ..... 10 2017 200 488

(51) Int. Cl.
*G10K 11/178* (2006.01)
*H04R 1/28* (2006.01)
(Continued)

(52) U.S. Cl.
CPC ..... *G10K 11/178* (2013.01); *H04R 1/2834* (2013.01); *H04R 1/403* (2013.01);
(Continued)

(58) Field of Classification Search
None
See application file for complete search history.

(56) References Cited

U.S. PATENT DOCUMENTS 1,828,284 A 10/1931 Clinton
5,675,658 A * 10/1997 Brittain ..... A61F 11/14 381/186

(Continued)

FOREIGN PATENT DOCUMENTS

DE 102006049543 A1 12/2007
JP H059094 U 2/1993

(Continued)

OTHER PUBLICATIONS

Agerkvist, Finn, "Modelling Loudspeaker Non-Linearities", 32nd International Conference of the Audio Engineering Society: DSP for Loudspeakers. Hillerød, Denmark, Sep. 2007, Sep. 2007.

(Continued)

*Primary Examiner* — Paul W Huber
(74) *Attorney, Agent, or Firm* — Perkins Coie LLP; Michael A. Glenn

(57) ABSTRACT

Embodiments provide a compensator for a loudspeaker system having a first loudspeaker group having at least one sound transducer, the first loudspeaker group being configured to generate a first sound signal based on an audio signal, the sound signal having a useful signal portion and a distortion signal portion. The compensator has a second loudspeaker group having at least one sound transducer, the second loudspeaker group being configured to generate a second sound signal based on a compensation signal, the second sound signal compensating and/or reducing the distortion signal portion when superimposed with the first sound signal.

19 Claims, 8 Drawing Sheets

(51) Int. Cl.
*H04S 7/00* (2006.01)
*H04R 1/40* (2006.01)

(52) U.S. Cl.
CPC ..... *H04S 7/301* (2013.01); *G10K 2210/1053* (2013.01); *H04R 2201/403* (2013.01); *H04S 2400/11* (2013.01)

(56) References Cited

U.S. PATENT DOCUMENTS

| | | | | |
|---|---|---|---|---|
| 6,477,255 | B1 * | 11/2002 | Yoshida | H04R 5/02 381/302 |
| 7,190,796 | B1 | 3/2007 | Kashani | |
| 9,679,551 | B1 * | 6/2017 | Wiggins | H04R 1/1083 |
| 10,615,816 | B2 * | 4/2020 | Jang | H04R 3/12 |
| 2010/0027805 | A1 * | 2/2010 | Itou | H04S 7/303 381/71.12 |
| 2010/0183156 | A1 * | 7/2010 | Park | G10K 11/178 381/17 |
| 2014/0003620 | A1 * | 1/2014 | Rill | G06F 3/165 381/86 |
| 2015/0003626 | A1 * | 1/2015 | Trammell | G10K 11/17823 381/71.7 |
| 2015/0100310 | A1 | 4/2015 | Cha et al. | |
| 2017/0213541 | A1 * | 7/2017 | MacNeille | G06F 3/165 |

FOREIGN PATENT DOCUMENTS

| | | | |
|---|---|---|---|
| JP | H09284882 | A | 10/1997 |
| WO | 2010091999 | A1 | 8/2010 |

OTHER PUBLICATIONS

Beerling, Marcel A. et al., "Reduction on Nonlinear Distortion in Loudspeakers with Digital Motional Feedback", 96th Convention of the Audio Engineering Society. Amsterdam, Netherlands, Feb. 1994, Feb. 1994.
Hall, David S, "Design Considerations for an Accelerometer-Based Dynamic Loudspeaker Motional Feedback System", 87th Convention of the Audio Engineering Society. New York, USA, Oct. 1999.
Siemens, Werner V. et al., "Telephon and Rufapparate mit magnetischer Gleichgewichtslage der schwingenden Theile", Dec. 1877.—German Patent No. 2355, 1877.
Al-Ali, Khalid M., "Loudspeakers: Modeling and Control", University of California at Berkeley, Diss., 1999.
Anderson, Martin, "Compensation of Nonlinearities in Transducers", Technical University of Denmark, Master thesis, 2005.
Bai, Mingsian et al., "Expert diagnostic system for movingcoil loudspeaker using nonlinear modeling", Journal of the Acoustical Society of America 125 (2009), No. 2, 2009, pp. 819-830.
Bright, Andrew , "Active Control of Loudspeakers—1 of 6", An Investigation of Practical Applications, Technical University of Denmark, Diss. 2002, 2002.
Bright, Andrew , "Active Control of Loudspeakers—2 of 6", An Investigation of Practical Applications, Technical University of Denmark, Diss. 2002, 2002.
Bright, Andrew , "Active Control of Loudspeakers—3 of 6", An Investigation of Practical Applications, Technical University of Denmark, Diss. 2002, 2002.
Bright, Andrew , "Active Control of Loudspeakers—4 of 6", An Investigation of Practical Applications, Technical University of Denmark, Diss. 2002, 2002.
Bright, Andrew, "Active Control of Loudspeakers—6 of 6", An Investigation of Practical Applications, Technical University of Denmark, Diss. 2002, 2002.
Brightt, Andrew, "Active Control of Loudspeakers—5 of 6", An Investigation of Practical Applications, Technical University of Denmark, Diss. 2002, 2002.
Brunet, Pascal, "Nonlinear System Modeling and Identification of Loudspeakers", Northeastern University Boston, Massachusetts, Diss. Apr. 2014, Apr. 2014.
Farina, Angelo, "Simultaneous Measurement of Impulse Response and Distortion with a Swept-Sine Technique", 108th Convention of the Audio Engineering Society. Paris, France, Feb. 2000, Feb. 2000.
Goertzel, Gerald, "An Algorithm for the Evaluation of Finite Trigonometric Series", The American Mathematical Monthly 65 (1958), No. 1,, 1958, pp. 34-35.
Hilmisson, Reynir, "Feedback Linearisation of Low Frequency Loudspeakers", Technical University of Denmark, Master thesis, 2009, 2009.
IEC 60268-5, "Sound system equipment", Part 5: Loudspeakers—IEC Publication 60268-5, May 2003.
Jakobsson, David et al., "Modelling and Compensation of Nonlinear Loudspeaker", Chalmers University of Technology, Master thesis 2010, 2010.
Khalil, Hassan K., "Nonlinear Systems", 1st edition, Prentice-Hall, Upper Saddle River, USA—1 of 5, 1996.
KH, Hassan K., "Nonlinear Systems", 1st edition, Prentice-Hall, Upper Saddle River, USA—2 of 5, 1996.
KH, Hassan K., "Nonlinear Systems", 1st edition, Prentice-Hall, Upper Saddle River, USA—3 of 5, 1996.
Khalil, Hassan K., "Nonlinear Systems", 1st edition, Prentice-Hall, Upper Saddle River, USA—4 of 5, 1996.
Khalil, Hassan K., "Nonlinear Systems", 1st edition, Prentice-Hall, Upper Saddle River, USA—5 of 5, 1996.
Klippel, Wolfgang, "Active Compensation of Transducer Nonlinearities", Preprint in 23rd International Conference of the Audio Engineering Society: Signal Processing in Audio Recording and Reproduction. Kopenhagen, Denmark, May 2003.
Klippel, Wolfgang, "Active Reduction of Nonlinear Loudspeaker Distortion", Active 99. Fort Lauderdale, Florida, USA, Dec. 1999, Dec. 1999, 1135.
Klippel, Wolfgang, "Adaptive Nonlinear Control of Loudspeaker Systems", Journal of the Audio Society of America 26 (1998), 1998, 939-954.
Klippel, Wolfgang, "Assessment of Voice-Coil Peak Displacement Xmax", Journal of the Audio Engineering Society 51 (2003), No. 5; http://www.aes.org/e-lib/browse.cfm?elib=12227, 2003, 307-324.
Klippel, Wolfgang, "Auralization of Signal Distortion in Audio Systems", Part 2: Transducer Modeling, AES Convention 136, Apr. 2014, XP040637076, Apr. 2014.
Klippel, Wolfgang, "Auralization of Signal Distortion in Audio Systems", Part 1: Generic Modeling, AES Convention 135, Oct. 2013, XP040633266, Oct. 2013.
Klippel, Wolfgang, "Diagnosis and Remedy of Nonlinearities in Electrodynamical Transducers", 109th Convention of the Audio Engineering Society. Los Angeles, USA, Sep. 2000.
Klippel, Wolfgang, "Direct Feedback Linearization of Nonlinear Loudspeaker Systems", In: 102th Convention of the Audio Eng. Society. München, Germany, Mar. 1997.
Klippel, Wolfgang, "Loudspeaker Nonlinearities—Causes, Parameters, Symptoms", Journal of the Audio Engineering Society 54 (2006), No. 10, 2006, 907-939.
Klippel, Wolfgang, "Nonlinear Adaptive Controller for Loudspeaker with Current Sensor", 106th Convention of the Audio Eng. Society. München, Germany, 1999.
Klippel, Wolfgang, "Sound Quality of Audio Systems", Vorlesungsskript, Mar. 2016.
Klippel, Wolfgan , "Speaker Auralization—Subjective Evaluation of Nonlinear Distortion", 110th Convention of the Audio Engineering Society. Amsterdam, Netherlands, May 2001.
Klippel, Wolfgang, "The Mirror Filter—A New Basis for Reducing Nonlinear Distortion and Equalizing Response in Woofer Systems", Journal of the Audio Engineering Society 40 (1992), No. 9, 675-691. http://www.aes.org/e-lib/browse.cfm?elib=7034, 1992, 675-691.
Krump, G, "Zur Wahrnehmbarkeit von Modulationsverzerrungen", Fortschritte der Akustik. Hamburg, Germany : DAGA, 2001.
Krump, Gerhard, "Der Lautsprecher als Synthese von Messtechnik, Simulation und Pychoakustik", Fortschritte der Akustik, München, Germany: DAGA, 2005.

(56) References Cited

OTHER PUBLICATIONS

Krump, Gerhard, "Zur Wahrnehmbarkeit von tieffrequenten Verzerrungen", Fortschritte der Akustik. Oldenburg, Germany : DAGA, 2000.
Müller, Swen , "Digitale Signalverarbeitung für Lautsprecher", TU Aachen, Diss., Jan. 1999.
Müller, Swen et al., "Transfer-Function Measurement with Sweeps", Journal of the Audio Engineering Society 49 (2001), Nr. 6; http://www.aes.org/e-lib/browse.cfm?elib=10189, 2001, 443-471.
Oyen, Karsten , "Compensation of Loudspeaker Nonlinearities", DSP implementation, Norwegian University of Science & Technology, Master Thesis, 2007.
Pedersen, Bo R. , "Error Correction of Loudspeakers", A study of Loudspeaker Design supported by Digital Signal Processing. Aalborg University, Diss. May 2008, May 2008.
Schurer, Hans et al., "Exact Input-Output Linearization", The Journal of the Acoustical Soc. of America 44, 1995, 1995.
Schurer, Hans , "Linearization of Electroacoustic Transducers—1 of 5", University of Twente Enschede, Diss., Oct. 1997, Oct. 1997.
Schurer, Hans , "Linearization of Electroacoustic Transducers—2 of 5", University of Twente Enschede, Diss., Oct. 1997, Oct. 1997.
Schurer, Hans , "Linearization of Electroacoustic Transducers—3 of 5", University of Twente Enschede, Diss., Oct. 1997, Oct. 1997.
Schurer, Hans , "Linearization of Electroacoustic Transducers—4 of 5", University of Twente Enschede, Diss., Oct. 1997, Oct. 1997.
Schurer, Hans , "Linearization of Electroacoustic Transducers—5 of 5", University of Twente Enschede, Diss., Oct. 1997, Oct. 1997.
Shmilovits, Doron , "On the definition of total harmonic distortion and its effect on measurement interpretation", In: Power Delivery, IEEE Transactions on 20 (2005) No. 1, pp. 526-528.—ISSN 0885_8977http://dx.doi.org/10.1109/TPWRD.2004.839744., 2005, 526-528.
Small, Richard H. , "Closed Box Loudspeaker Systems, Part 1", 2006.
Small, Richard H. , "Closed Box Loudspeaker Systems, Part 2", 2006.
Spors, Sascha , "Active Listening Room Compensation for Spatial Sound Reproduction Systems", Friedrich-Alexander-Univ. Erlangen-Nürnberg, Diss. Oct. 2005, Oct. 2005.
Thiele, Neville A. , "Loudspeakers in Vented Boxes: Part 1", In: Journal of the Audio Engineering Society 19 (1971), No. 5, S. 181-191, 1971.
Thiele, Neville A. , "Loudspeakers in Vented Boxes: Part 2", Journal of the Audio Engineering Society 19 (1971), No. 5, S. 192-204, 1971.
Weissensteiner, Wolfgang , "Angewandte Lautsprechermesstechnik im Klein—und Großsignalbereich am Beispiel des Klippel-Messsystems", TU Graz, Diplomarbeit, Feb. 2014—1 of 3, Feb. 2014.
Weissensteiner, Wolfgang , "Angewandte Lautsprechermesstechnik im Klein—und Großsignalbereich am Beispiel des Klippel-Messsystems", TU Graz, Diplomarbeit, Feb. 2014—2 of 3, Feb. 2014.
Weissensteiner, Wolfgang , "Angewandte Lautsprechermesstechnik im Klein—und Großsignalbereich am Beispiel des Klippel-Messsystems", TU Graz, Diplomarbeit, Feb. 2014—3 of 3, Feb. 2014.
Zwicker, Eberhard et al., "Psychoacoustics Facts and Models—1 of 7", 3rd Edition. Springer, Berlin/Heidelberg, Germany 2006, 2006.
Zwicker, Eberhard et al., "Psychoacoustics Facts and Models—2 of 7", 3rd Edition. Springer, Berlin/Heidelberg, Germany 2006, 2006.
Zwicker, Eberhard et al., "Psychoacoustics Facts and Models—3 of 7", 3rd Edition. Springer, Berlin/Heidelberg, Germany 2006, 2006.
Zwicker, Eberhard et al., "Psychoacoustics Facts and Models—4 of 7", 3rd Edition. Springer, Berlin/Heidelberg, Germany 2006, 2006.
Zwicker, Eberhard et al., "Psychoacoustics Facts and Models—5 of 7", 3rd Edition. Springer, Berlin/Heidelberg, Germany 2006, 2006.
Zwicker, Eberhard et al., "Psychoacoustics Facts and Models—6 of 7", 3rd Edition. Springer, Berlin/Heidelberg, Germany 2006, 2006.
Zwicker, Eberhard et al., "Psychoacoustics Facts and Models—7 of 7", 3rd Edition. Springer, Berlin/Heidelberg, Germany 2006, 2006.

* cited by examiner

COMPENSATION MEANS FOR A LOUDSPEAKER SYSTEM AND LOUDSPEAKER SYSTEM

CROSS-REFERENCE TO RELATED APPLICATIONS

This application is a continuation of copending International Application No. PCT/EP2017/067603, filed Jul. 12, 2017, which is incorporated herein by reference in its entirety, and additionally claims priority from German Application No. 10 2016 212 828.0, filed Jul. 13, 2016, and from German Application No. 10 2017 200 488.6, filed Jan. 13, 2017, which are both incorporated herein by reference in their entirety.

BACKGROUND OF THE INVENTION

Embodiments of the present invention relate to compensation means for a loudspeaker system and to a loudspeaker system, to a calculating unit, and to a respective method. Further embodiments relate to controlling a loudspeaker array or array of actuators for sound emission.

Loudspeakers (sound transducers, actuators) are electromechanical systems having non-linear characteristics. The output signal (like membrane deflection, membrane velocity, sound pressure) is in a non-linear relation/ratio to the input signal (like a voltage). The non-linear behavior results in non-linear distortions. Non-linear distortions are signal portions in the spectrum of the output signal which are not contained in the spectrum of the input signal (like harmonic distortions, intermodulation distortions). The result is undesired sound coloration.

Known technology uses methods from regulation and control technology. An additional signal is added to the input signal, which is compensated by the intrinsic non-linear behavior of the transducer. This means that the excitation signal of the loudspeaker consists of the input signal and a second control signal/compensation signal. The effect of this is a linear relation between the input and output signals. The compensation signal added can increase the electrical energy fed to the loudspeaker, and correspondingly subject it to stronger a load. The result is stronger an aging process for the mechanical characteristics, and additionally the thermal load is increased. Only those non-linearities caused by the electromechanical drive may be compensated, i.e., for example, the non-linear coupling/force factor between the electrical and the mechanical side, or the effects of the non-linear suspension (spring) of the membrane, but not non-linearities of other causes which form only in the sound pressure, like Doppler distortions or non-linearities in a resonator or treble horn.

The non-linear behavior of systems with no intrinsic drive cannot be compensated using this approach, like for loudspeaker with one or several active membranes and one or several passive membranes, there are no known solution approaches for compensating the distortion spectrum emitted by the passive membrane(s), since the passive membranes do not comprise their own drive. Consequently, there is need for an improved approach.

SUMMARY

According to an embodiment, compensation means for a loudspeaker system may have a first loudspeaker group having at least one sound transducer, the first loudspeaker group being configured to generate a first sound signal based on an audio signal, the first sound signal having a useful signal portion and a distortion signal portion, the compensation means having: a second loudspeaker group having at least one sound transducer, the second loudspeaker group being configured to generate a second sound signal based on a compensation signal, the second sound signal compensating and/or reducing the disturbing signal portion when superimposed with the first sound signal.

According to another embodiment, a loudspeaker system may have: a first loudspeaker group having at least one sound transducer, the first loudspeaker group being configured to generate a first sound signal based on an audio signal, the first sound signal having a useful signal portion and a distortion signal portion; and a second loudspeaker group having at least one sound transducer, the second loudspeaker group being configured to generate a second sound signal based on a compensation signal, the second sound signal compensating and/or reducing the disturbing signal portion when superimposed with the first sound signal.

Another embodiment may have a calculating unit having a signal synthesizer, wherein the signal synthesizer is configured to determine a compensation signal starting from information on a distortion signal portion which, together with a useful signal portion, is comprised by a first sound signal generated by a first loudspeaker group on the basis of an audio signal, wherein the compensation signal is suitable to compensate and/or reduce the distortion signal portion when outputting the same as a second sound signal via a second loudspeaker group by superpositioning with the first sound signal.

According to another embodiment, a method for generating a useful signal portion may have the steps of: outputting, using a first loudspeaker group having at least one sound transducer, a first sound signal based on an audio output signal, the first sound signal having a useful signal portion and a distortion signal portion; and outputting, using a second loudspeaker group having at least one sound transducer, a second sound signal based on a compensation signal, the second sound signal compensating and/or reducing the distortion signal portion when superimposed with the first sound signal.

According to still another embodiment, a method for calculating a compensation signal may have the steps of: determining a compensation signal starting from information on a distortion signal portion which, together with a useful signal portion, is comprised by a first sound signal generated by a first loudspeaker group on the basis of an audio signal; and compensating and/or reducing the distortion signal portion when outputting the compensation signal as a second sound signal via a second loudspeaker group by superpositioning with the first sound signal.

Another embodiment may have a non-transitory digital storage medium having stored thereon a computer program for performing a method for generating a useful signal portion, having the steps of: outputting, using a first loudspeaker group having at least one sound transducer, a first sound signal based on an audio output signal, the first sound signal having a useful signal portion and a distortion signal portion; and outputting, using a second loudspeaker group having at least one sound transducer, a second sound signal based on a compensation signal, the second sound signal compensating and/or reducing the distortion signal portion when superimposed with the first sound signal, when said computer program is run by a computer.

Still another embodiment may have a non-transitory digital storage medium having stored thereon a computer program for performing a method for calculating a compensation signal, having the steps of: determining a compensation signal starting from information on a distortion signal portion which, together with a useful signal portion, is comprised by a first sound signal generated by a first loudspeaker group on the basis of an audio signal; and compensating and/or reducing the distortion signal portion when outputting the compensation signal as a second sound signal via a second loudspeaker group by superpositioning with the first sound signal, when said computer program is run by a computer.

According to another embodiment, compensation means for a loudspeaker system may have a first loudspeaker group having at least one sound transducer, the first loudspeaker group being configured to generate a first sound signal based on an audio signal, the first sound signal having a useful signal portion and a distortion signal portion, the compensation means having: a second loudspeaker group having at least one sound transducer, the second loudspeaker group being configured to generate a second sound signal based on a compensation signal, the second sound signal compensating and/or reducing the disturbing signal portion when superimposed with the first sound signal; wherein the compensation means have a calculating unit having a signal synthesizer configured to generate the compensation signal starting from information on the distortion signal portion; and wherein the calculating unit has a signal analyzer configured to analyze the first sound signal relative to the useful signal portion and the distortion signal portion and to extract the information on the distortion signal portion; wherein the signal synthesizer is configured to invert the extracted distortion signal portion in order to obtain the compensation signal.

According to another embodiment, a loudspeaker system may have: a first loudspeaker group having at least one sound transducer, the first loudspeaker group being configured to generate a first sound signal based on an audio signal, the first sound signal having a useful signal portion and a distortion signal portion; and a second loudspeaker group having at least one sound transducer, the second loudspeaker group being configured to generate a second sound signal based on a compensation signal, the second sound signal compensating and/or reducing the disturbing signal portion when superimposed with the first sound signal; wherein the loudspeaker system has a calculating unit having a signal synthesizer configured to generate the compensation signal starting from information on the distortion signal portion; and wherein the calculating unit has a signal analyzer configured to analyze the first sound signal relative to the useful signal portion and the distortion signal portion and to extract the information on the distortion signal portion; wherein the signal synthesizer is configured to invert the extracted distortion signal portion in order to obtain the compensation signal.

Another embodiment may have a calculating unit having a signal synthesizer, wherein the signal synthesizer is configured to determine a compensation signal starting from information on a distortion signal portion which, together with a useful signal portion is comprised by a first sound signal generated by a first loudspeaker group on the basis of an audio signal, wherein the compensation signal is suitable to compensate and/or reduce the distortion signal portion when outputting the same as a second sound signal via a second loudspeaker group by superpositioning with the first sound signal; wherein the signal synthesizer is configured to generate the compensation signal starting from information on the distortion signal portion; and wherein the calculating unit has a signal analyzer configured to analyze the first sound signal relative to the useful signal portion and the distortion signal portion and to extract the information on the distortion signal portion; wherein the signal synthesizer is configured to invert the extracted distortion signal portion in order to obtain the compensation signal.

According to another embodiment, a method for generating a useful signal portion may have the steps of: outputting, using a first loudspeaker group having at least one sound transducer, a first sound signal based on an audio output signal, the first sound signal having a useful signal portion and a distortion signal portion; determining a compensation signal starting from information on a distortion signal portion which, together with a useful signal portion, is comprised by a first sound signal; and outputting, using a second loudspeaker group having at least one sound transducer, a second sound signal based on the compensation signal, the second sound signal compensating and/or reducing the distortion signal portion when superimposed with the first sound signal; wherein determining has the sub-steps of generating the compensation signal starting from information on the distortion signal portion, analyzing the first sound signal relative to the useful signal portion and the distortion signal portion, extracting the information on the distortion signal portion and inverting the extracted distortion signal portion in order to obtain the compensation signal.

According to another embodiment, a method for calculating a compensation signal may have the steps of: determining a compensation signal starting from information on a distortion signal portion which, together with a useful signal portion, is comprised by a first sound signal generated by a first loudspeaker group on the basis of an audio signal; and compensating and/or reducing the distortion signal portion when outputting the compensation signal as a second sound signal via a second loudspeaker group by superpositioning with the first sound signal; wherein determining has the sub-steps of generating the compensation signal starting from information on the distortion signal portion, analyzing the first sound signal relative to the useful signal portion and the distortion signal portion, extracting the information on the distortion signal portion and inverting the extracted distortion signal portion in order to obtain the compensation signal.

Embodiments of the present invention provide compensation means for a loudspeaker system comprising a first loudspeaker group having at least one sound transducer. The first loudspeaker group is configured to generate a first sound signal based on an audio signal, the sound signal comprising a useful signal portion and a distortion signal portion. The distortion signal portion usually results from non-linearities when generating the useful signal by means of the one or several sound transducers of the first loudspeaker group. The compensation means comprise at least a second loudspeaker group having at least one sound transducer, the second loudspeaker group being configured to generate a second sound signal, based on a compensation signal, which, when superimposed with the first sound signal, compensates and/or reduces the distortion signal portion (i.e. the disturbing portions or, generally, the undesired sound portions emitted). Exemplarily, the compensation signal (or control signal) can be derived from the distortion signal portion, like by inversion. This approach offers the advantage that an improved audio reproduction can be achieved since the distortion artefacts in the listening room are reduced or prevented.

Embodiments of the present invention are based on the finding that it is possible to optimize the sound pressure emitted of a loudspeaker or a group of several loudspeakers, containing a so-called distortion signal portion—i.e. an undesired/undesiredly emitted sound signal, like a side noise or disturbing noise—when reproducing a useful signal by reproducing, using an additional loudspeaker or an additional loudspeaker group, a further sound signal which is suitable for compensating the distortions of the first loudspeaker or the first loudspeaker group in the sound field, compensating here meaning eliminating or reducing. The second loudspeaker group is controlled by a so-called compensation signal which is dependent on the distortion spectrum of the loudspeaker or loudspeaker group emitting the actual audio signal.

In correspondence with another embodiment, a loudspeaker system is provided, comprising the first loudspeaker group for generating the actual audio signal and the second loudspeaker group for generating the compensation signal. In correspondence with embodiments, the first and second loudspeaker groups are arranged relative to each other such that superpositioning the second sound signal relative to the first sound signal takes place in a room or space of the sound field generated. In correspondence with embodiments, superpositioning takes place in the near field. This may, for example, be achieved by the first loudspeaker group being arranged relative to the second loudspeaker group at a small distance, like at most 3 m or, advantageously, at most 1 m. In addition, in correspondence with further embodiments, at least one sound transducer of the second loudspeaker group or the entire second loudspeaker group may be oriented relative to a sound field generated by the first loudspeaker group, or relative to the listening position for the sound field of the first loudspeaker group. In the embodiment in correspondence with which superpositioning takes place in the near field, it is to be mentioned that the particular advantage here is that the mode of action of the concept is not dependent on the listening place, that is an optimized listening experience can take place also in the far field relative to the first (or the second) loudspeaker group. In the embodiment in correspondence with which superpositioning is implemented such that it may take place at the listening position, it is to be mentioned that the particular advantage here is that optimization is present for said one listening position.

In correspondence with further embodiments, loudspeaker group 2 may comprise a plurality of loudspeakers and be configured to perform beam forming. Here, it is advantageously possible to exactly determine the place of superpositioning by means of the sound cones generated and oriented using controlling the loudspeakers of the second loudspeaker group. In correspondence with embodiments, a stereo sound field or a surround sound field can be generated by such a loudspeaker system. This means that, in correspondence with this extended embodiment, the first loudspeaker group comprises at least two or even more channels. This embodiment may be employed in combination with the beam-forming approach. Alternatively, it is also conceivable, for example when the loudspeakers of the first loudspeaker group generate a plurality of sound fields, for the loudspeakers of the second loudspeaker group to be configured to generate a plurality of sound fields. Here, a plurality of loudspeakers may, for example, be used in loudspeaker group 2. In correspondence with further embodiments, a 1:1 allocation between a loudspeaker of the first loudspeaker group and a loudspeaker of the second loudspeaker group is also conceivable.

Further embodiments relate to a calculation unit which, in correspondence with embodiments, comprises a signal synthesizer configured to determine or generate the compensation signal starting from information on the distortion signal portion. In correspondence with further embodiments, the calculation unit additionally comprises a signal analyzer configured to analyze the first sound signal as regards the useful signal portion and the distortion signal portion in order to extract the information on the distortion signal portion. In correspondence with further embodiments, the signal analyzer can compare the audio signal to the first sound signal. Here, the signal usually is equipped with a receiver for the first signal, like a microphone or, generally, means for measuring acceleration, velocity and/or deflection of the membrane or, generally, the sound emission area. Alternatively, the signal analyzer may also be configured to analyze the audio signal and simulate the distortion signal portion. In the simulation variation, the means for determining the air-borne or structure-borne sound or, generally, the disturbing signal may advantageously be omitted. This is of advantage as regards complexity thereof. Irrespective of whether comparing or simulating takes place, the information on the distortion signal portion contain information isolated from the useful signal. Both variations advantageously allow determining the distortion signal portion, wherein, in the variation of analyzing the first sound signal, the result is more realistic since the signal is analyzed with regard to all the influence factors present at this time. Alternatively, electrical measurement means analyzing the current and/or voltage behavior at the loudspeaker terminals may also be provided. Measuring voltage and current is of advantageous since parameters needed for simulation can be updated by an adaptive system identification.

In correspondence with embodiments, the signal synthesizer is configured to invert the distortion signal portion in order to obtain the compensation signal. Here, in correspondence with further embodiments, the signal synthesizer may be configured to determine the compensation signal while using the transfer function of the at least one sound transducer of the second loudspeaker group. The advantage resulting here is that potential distortions of the second loudspeaker group can be considered already at a preliminary stage.

A further embodiment provides the calculation unit comprising the signal synthesizer and, optionally, the signal analyzer.

In correspondence with further embodiments, a method for generating a useful signal portion is defined. The method comprises the steps of outputting the first sound signal and outputting the second sound signal so that the second sound signal, when superimposed with the first sound signal, compensates or reduces the distortion signal portion of the first sound signal.

A further embodiment provides a method for calculating a compensation signal. The method comprises the steps of determining a compensation signal starting from information on a distortion signal portion which, together with a useful signal portion, is comprised by a first sound signal generated by a first loudspeaker group on the basis of an audio signal. The next step is performing compensation or reduction of the distortion signal portion by outputting the compensation signal portion as a second sound signal in order to obtain the desired equalization (or distortion correction)/sound improvement when superimposed with the first sound signal.

In correspondence with a further embodiment, the steps of the methods discussed above or at least one or several steps of the methods discussed above may be performed using a computer. This is why a further embodiment provides a computer program comprising program code for performing the method.

BRIEF DESCRIPTION OF THE DRAWINGS

Embodiments of the present invention will be discussed below referring to the appended drawings, in which.

DETAILED DESCRIPTION OF THE INVENTION

Figure 1A:
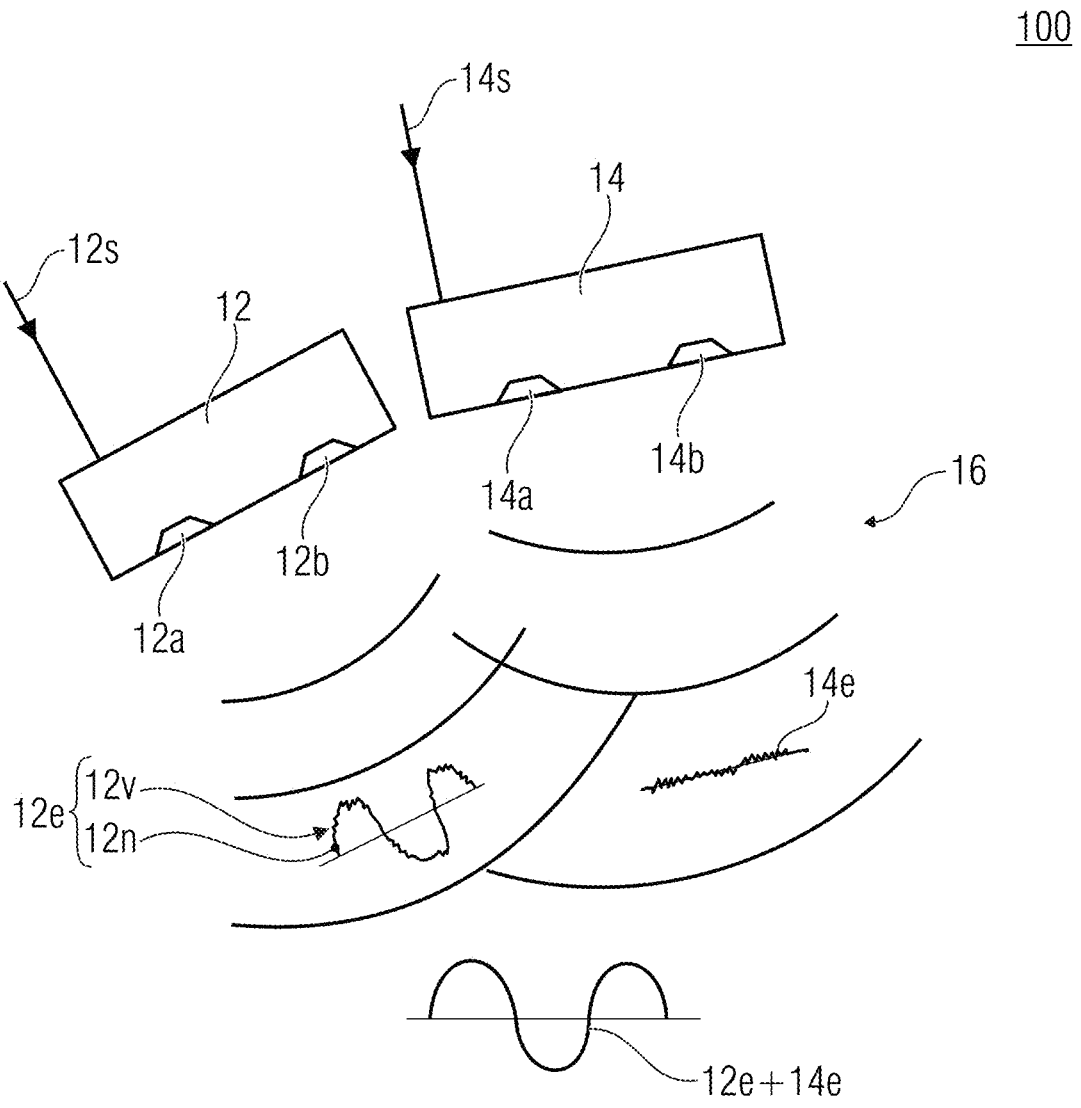
FIG. 1*a* shows a schematic block diagram of a loudspeaker arrangement having a first and a second loudspeaker group in accordance with a basic embodiment.

Before discussing below in greater detail embodiments of the present invention making reference to the appended drawings, it is to be pointed out that elements and structures of equal effect are provided with equal reference numerals so that the description thereof is mutually applicable and interchangeable.

FIG. 1*a* shows a loudspeaker system 100 comprising a first loudspeaker 12 and a second loudspeaker 14. The first loudspeaker 12 belongs to a first loudspeaker group and in this embodiment comprises two sound transducers 12*a* and 12*b*, the second sound transducer being optional. The second loudspeaker 14 in turn comprises two sound transducers, that is sound transducer 14*a* and optional sound transducer 14*b*. The sound transducers 14*a* and 14*b*, or the loudspeaker 14, belong to the second loudspeaker group. The two are located in direct proximity to each other, for example, and angled so that they emit the sound in a common room provided with reference numeral 16, for example. Observed from a different perspective this means that, in correspondence with embodiments, both the first loudspeaker 12, or sound transducers 12*a* and 12*b*, and the second loudspeaker 14, or sound transducers 14*a* and 14*b*, emit the first and second sound signals, respectively, (including all the portions observed) to the front, i.e. via the front membrane of the sound transducers 12*a*, 12*b*, 14*a* and 14*b*.

The loudspeaker 12 emits a sound signal 12*e* based on an audio signal 12*s*. The sound signal 12*e* comprises a useful signal 12*n* on the one hand and a distortion signal 12*v* on the other hand.

The loudspeaker 14 of the second loudspeaker group serves for superimposing the sound signal 12*e* such that the distortion signal portion 12*v* is reduced or removed. Here, the second loudspeaker group, based on a compensation signal 14, emits a sound signal 14*e* suitable for reducing or eliminating the distortion signal portion 12*b* when superimposed with the signal 12*e*, in order to obtain as a result the undistorted signal 12*e*+14*e* which is comparable or similar to the useful signal 12*n*.

In correspondence with embodiments, the compensation signal 14*e* may, for example, be an inverse of the distortion signal 12*v*. This means that the control signal 14*s* is, for example, derived from the sound signal 12*e* or the audio signal 12*s*. The control signal for the compensation signal 14*e* may also be determined while considering the transfer characteristic of the compensation loudspeaker(s) so that there are no additional disturbing noises.

In correspondence with embodiments, superimposing signal 14*e* or 12*e* takes place in room 16 or, more precisely, in correspondence with embodiments, in the near field of the two loudspeakers 12 and 14. It would be of advantage here, but not necessary, for the loudspeakers 12 and 14 to be distanced from each other at a small distance, like 1 m or at most 3 m. The result of this is that the sound signals 12*e* and 14*e* are superimposed in the near field so that a distortion-reduced or distortion-free signal 12*e*+14*e* can be perceived at practically every listening position in room 16. Two formulae are known for determining the optimum distance, by means of which the maximum or frequency-dependent distance of the loudspeaker groups can be determined. The background will be discussed below:

The idea and potential of equalizing even greater loudspeaker arrays than the 6 array using an equalizing loudspeaker entails considering the influence of the geometrical transducer distances between distortion and equalizing loudspeakers. In the introduction to this chapter, the correlation of the compensation method with Active Noise Control systems has already been mentioned. In the theory of ANC systems, the influence of the distance of the disturbing source to the control loudspeaker is examined thoroughly. Thus, assuming point sound sources, the active suppression of their sound fields in free-field emission is considered. The two sound sources are considered to be acoustic monopoles.

The minimization of the harmonic disturbing signal by the equalizing loudspeaker is a basic object of ANC systems. The sound pressure in the far field of the distortion loudspeaker is defined as follows:

$$p(r_F) = \frac{jwp_0 v e^{jkr}}{4\pi r},$$

with velocity v, r=|rF−rZ| and wave number k. By superimposing both sound sources, the resulting sound pressure is:

$$p(r_F) = \frac{jwp_0 v_Z e^{jkr_Z}}{4\pi r_Z} + \frac{jwp_0 v_E e^{jkr_E}}{4\pi r_E}$$

What is searched for is the velocity vE which, with a given velocity vZ, minimizes the sound field. This means that this velocity is defined by:

$$v_E = -\frac{r_Z}{r_E} v_Z e^{-jkr(r_Z - r_E)}.$$

The velocity of the equalizing loudspeaker, with regard to its amplitude, has to be proportional to the relative distance of the far field position and has to generate a sound pressure signal which is out of phase by 180° relative to the signal of the distortion loudspeaker when same reaches the far-field position. The question here is how great the distance d between the distortion and the equalizing loudspeaker is allowed to be in order to reduce the non-linearities to an audible extent not only at a certain point, but any point in the far field. For solving this question, at first a far field approximation in the above equation has to be applied. In the far field of the two loudspeakers, rE/rZ≈1 and rE≈rZ≈rF can be assumed. This far field approximation ensures that the sound pressure at a distance r can be minimized for every angle _F. This means that the equation can be simplified as follows:

$$v_E = -v_z e^{-jk(d \cos \theta_F)}.$$

Using this far field assumption and the possible conversion of equation $$p(r_F) = \frac{jwp_0 v_Z e^{jkr_Z}}{4\pi r_Z} + \frac{jwp_0 v_E e^{jkr_E}}{4\pi r_E}$$

result in the following distance criterion: 1−cos 2kd<½, the result being that kd<_/6 or d<_/12. The distance of directly neighboring loudspeakers in the loudspeaker array used is 4.3 cm. In accordance with the distance law, an optimum cancellation will work only up to f<c d·12≈660 Hz. Previous examinations where directly neighboring loudspeaker combinations were used, however, have revealed that frequencies up to at least 1200 Hz can be reduced to a measurable extent. The theory of the distance law, however, assumes complete cancellation, i.e. p=0, which, due to slight deviations of amplitude and phase, could never be reached and proven in the examinations.

A loudspeaker distance-dependent upper threshold frequency from which aliasing effects occur, is also known from using linear loudspeaker arrays, for example in wave-field synthesis or beam-forming. The arrangement of the loudspeakers resembles spatial sampling and the upper threshold frequency fAlias is defined by:

$$f_{Alias} = \frac{c}{d(1 + |\cos \alpha_{EW}|)},$$

with an angle of incidence EW of a planar wave relative to the loudspeaker array. With a loudspeaker distance of 4.3 cm, fAlias on the axis is 7930 Hz. A variation of the loudspeaker distance is to reveal information on starting from where the THD (total harmonic distortion) reduction is reduced considerably due to geometrical conditions. Thus, reference is to be made to the distance criterion of the ANC theory and the upper threshold frequency fAlias of the linear array technology. The evaluation has shown that the variation of the equalizing loudspeaker has smaller an influence on the quality of the compensation method than the variation of the distortion loudspeaker. This is why D2 was used as the distortion loudspeaker and D3-5 as equalizing loudspeakers for the geometrical examinations. 300 Hz was selected as the examination frequency, since it is expected that the influence of the transducer distances can be recognized most distinctly with the harmonics to be compensated up to 1500 Hz. The effectivity of the method was examined for several positions in space by rotating the loudspeaker array using a rotating device. The measurements could be performed at 0°, 45° and 90°. Thus, the loudspeaker array was mounted such that the respective loudspeaker combination was positioned on a horizontal line.

The following table shows the THD values and the corresponding THD reduction at different angles and different distances. At first, the THD reduction of the transducer combination D2Z, D3E matches that of the original measurement. With this transducer combination, the THD reduction remains stabile at the other microphone positions; at 45°, the harmonic distortion reduction, at 18.6 dB, is even considerably higher.

| | 0° | 45° | 90° |
|---|---|---|---|
| 4.3 cm THDZ | 11.5% | 10.3% | 9.6% |
| 4.3 cm THDZ + E | 2.4% | 1.2% | 2.7% |
| 4.3 cm reduction THD | 13.6 dB | 18.6 dB | 11.0 dB |
| 8.6 cm THDZ | 11.5% | 10.3% | 9.6% |
| 8.6 cm THDZ + E | 2.3% | 3.7% | 6.6% |
| 8.6 cm reduction THD | 14.0 dB | 8.9 dB | 3.25 dB |
| 12.9 cm THDZ | 11.5% | 10.3% | 9.6% |
| 12.9 cm THDZ + E | 2.9% | 5.5% | 10.2% |
| 12.9 cm reduction THD | 12.0 dB | 5.5 dB | −0.5 dB |

The reduction of the THD value at 0° also remains constant for greater distances. However, it decreases drastically when the loudspeaker array is rotated from its 0° position. With a transducer distance of 12.3 cm and 90°, the harmonic distortion is even increased. The harmonic distortion only makes an energetic statement on the sum of harmonic overtones. The spectral composition of the harmonic spectrum is not possible using the pure THD value. This entails considering the amplitude spectra. This also allows making a statement on starting from which frequency equalization is no longer possible, in dependence on the transducer distances and measuring angles. In this figure, it can be recognized that there is a dependence between angular distance and measuring angle and the reduction of individual spectrum lines. Thus, with a distance of 8.6 cm and 45°, the harmonic at 900 Hz can no longer be decreased, for example. With a transducer distance of 12.9 cm/90°, the lower threshold frequency is 600 Hz. Assuming the above formula, these frequencies all are considerably above the distance-dependent threshold frequencies which can be calculated in this way. These are 660 Hz at 4.3 cm, 330 Hz at 8.3 cm and 220 Hz at 12.9 cm. However, the distance criterion relates to ideal cancelling. A partial reduction can also be proven by the measuring results illustrated with higher frequencies. In theory, there is no angle-dependent influence. The distance criterion applies to all the points in the far field, which, however, does not match the measuring results illustrated. The purely theoretical consideration of complete cancelling, when keeping the distance criterion, is based on decreasing the radiation impedance. If the same equals zero, coupling of the membrane velocity to the surrounding air is prevented and the transducers emit no sound pressure to the far field. This means that, in a theoretically ideal case, an angle-dependent consideration is omitted. In real measurements, the radiation resistance is not decreased to zero and a part of the sound power is still emitted to the far field.

Cancelling does not only take place in the near field, but a position or angle-dependent cancellation also takes place on the measuring places in the far field. The runtime offset between distortion and equalizing loudspeaker, when considering a distance, on the axis, i.e. 0°, remains equal, i.e. does not have any influence on the cancellation in the far field. With an increasing angle, the runtimes between the two transducers examined differ and the reduction of certain harmonics deteriorates.

Figure 2A:
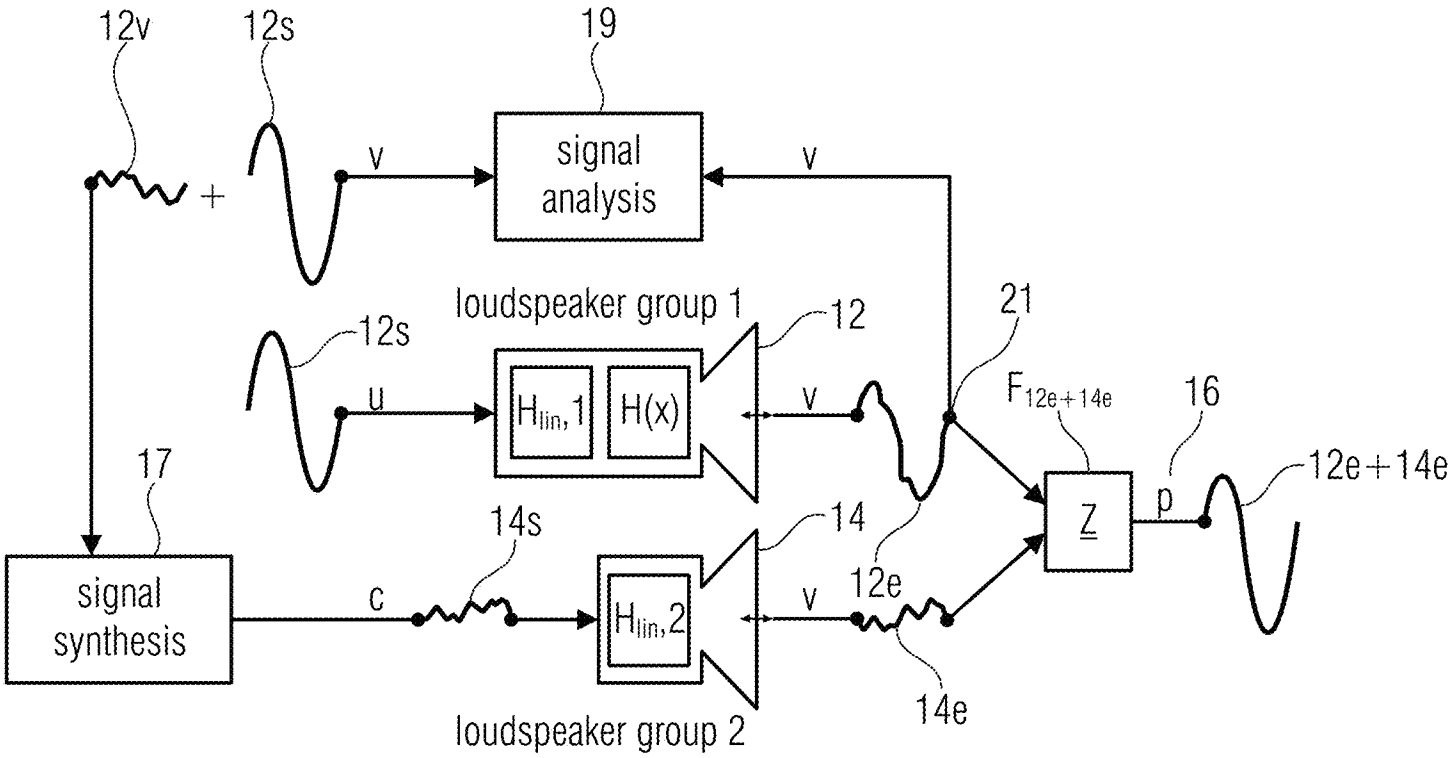
FIG. 2*a* shows a schematic block diagram for compensating the non-linearity of a sound transducer/sound transducer group 1 by additional sound transducers/sound transducer group 2 in accordance with an extended embodiment.
Figure 2B:
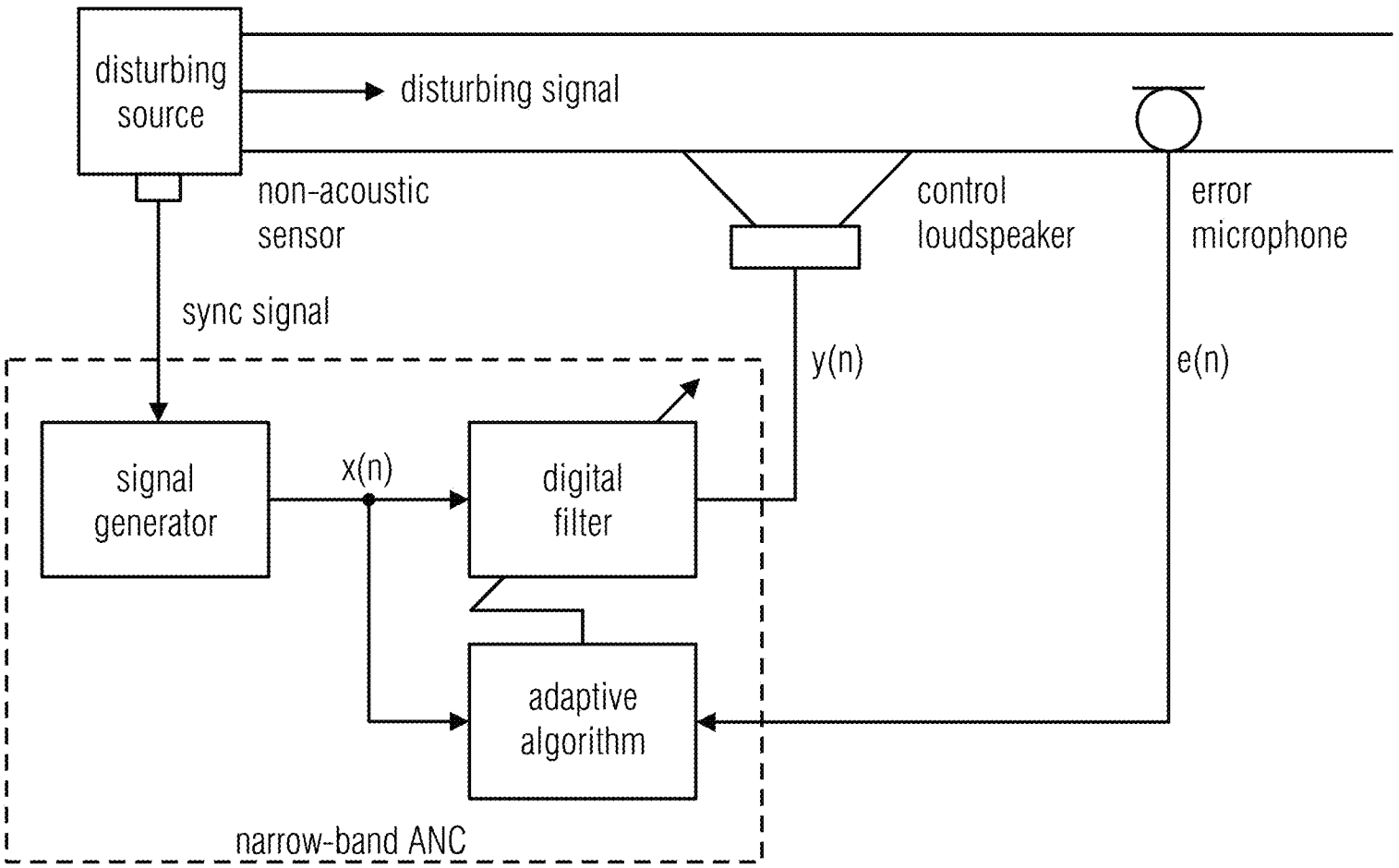
FIG. 2*b* shows a schematic block diagram for illustrating a basic configuration of a narrow-band Active Noise Control system.
Figure 2C:
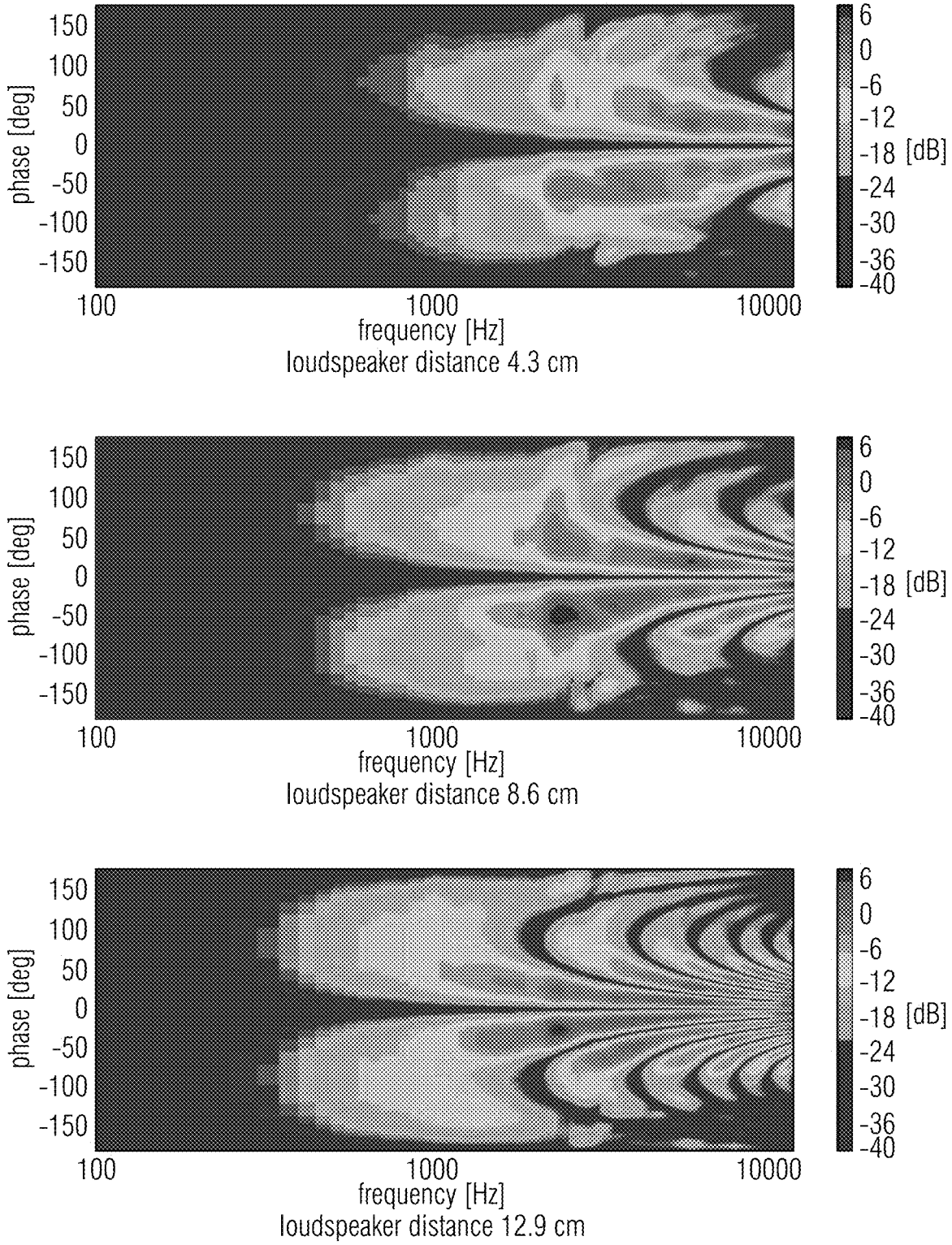
FIG. 2*c* shows a schematic illustration of simulated isobars of two opposite-phase transducers in different distances.

FIG. 2*c* illustrates the simulated isobars of two transducers at distances as mentioned above. Thus, the directional characteristic measured of the two transducers was considered for the simulation. In addition, excitation of the transducers was simulated such that one transducer emits sound completely out of phase, i.e. inverse to the second transducer. This idealized simulation consequently shows the emitted sound pressure in the far field of the transducer pair with an ideal control signal on the equalizing loudspeaker. Blue to orange regions show a decrease in the sound pressure of the distortion loudspeaker, red regions show an increase in the sound pressure. Using this illustration, reference can be made to the aliasing frequency in loudspeaker arrays.

When considering 45°, in accordance with the above equations, the following aliasing frequencies result: 4645 Hz for 4.3 cm, 2323 Hz for 8.6 cm and 1549 Hz for 12.9 cm. An increase in the sound pressure starting from 3350 Hz/4.3 cm, 2100 Hz/8.6 cm and 1250 Hz/12.9 cm can be recognized from the isobars. These values are each somewhat smaller than the calculated threshold frequencies, but the results of the equation used represent a practical guide value. In addition, the isobars represent well that a pronounced interference pattern forms above the aliasing frequency, which is dependent on the loudspeaker distance. However, since loudspeaker non-linearities result, above all, in the bass tone region and the distortion products occur in a wide region of angles even below the respective threshold frequency, the geometrical distance, in the ideal case, has little influence on the reduction of harmonic distortions. The weak effectivity of the real transducer pairs measured at different distances can be attributed to the fact that the phase position of the harmonics to be eliminated was not reached perfectly. or that the sound field is superimposed by additional portions, like edge reflections.

Due to the non-linear characteristics of the specific transducer principle, a loudspeaker or loudspeaker array 12 generates harmonic distortions and intermodulation distortions 12*v*. When placing an equalizing loudspeaker or compensation loudspeaker 14 geometrically close to the distorting individual loudspeaker or loudspeaker array 12, a calculated control signal 14*e* can be emitted via the compensation loudspeaker 14, which eliminates the distortion products in the sound field 16. Eliminating the distortion products corresponds to decreasing the radiation resistance (real part of the complex radiation impedance Re{Z}) of the distorted individual loudspeaker or loudspeaker array 12 in the frequency range where the distortion products are located. This reduces or prevents en emission of distortion artefacts to the far field. Since the compensation takes place already in the near field of the individual loudspeaker or loudspeaker array 12, the mode of operation is not dependent on the place of listening.

It is to be mentioned here that the two loudspeakers 12 and 14 emitting the sound 12*e* and 14*e*, respectively, in roughly the same direction, i.e. being rotated to each other, is an advantageous variation in the loudspeaker system 100.

Even when assuming the loudspeaker system 100 in the above embodiments, in correspondence with further embodiments, only the compensation means can be provided for a further loudspeaker system which comprises at least the loudspeaker 12. The compensation means are basically formed by the loudspeaker 14 or, generally, the second loudspeaker group having at least one sound transducer 14*a*.

Figure 1B:
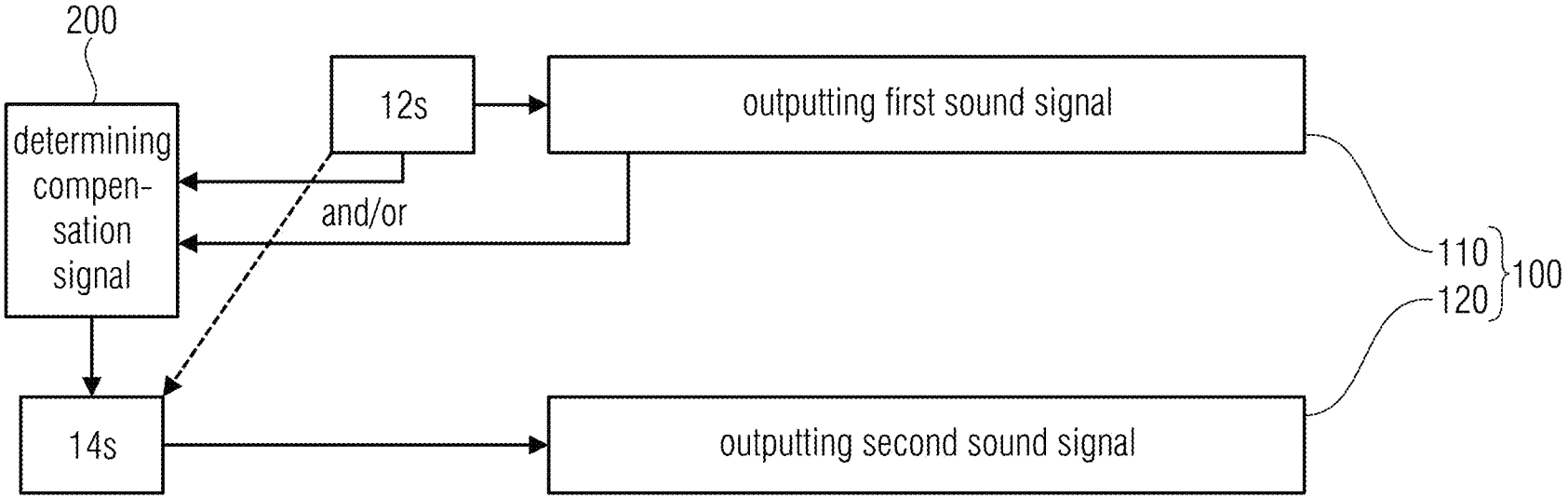
FIG. 1*b* shows a schematic flowchart of a corresponding compensation method.

The corresponding method is illustrated in FIG. 1*b*. FIG. 1*b* shows a method 100 which comprises the two basic steps 110 and 120. Basic step 110 relates to outputting the first sound signal while using the first loudspeaker group on the basis of the audio signal 12*s*. In the next step 120, the second sound signal is output for compensation. The second sound signal is based on the disturbing signal 14*s*. As is illustrated here by means of the broken lines, the disturbing signal 14*s* is dependent on the audio signal 12*s*.

In correspondence with further embodiments, the method 100 may be supplemented by the method 200 which, starting from the audio signal 12*s*, for example, determines the compensation signal 14*s*, advantageously in combination with the first sound signal. The method 200 comprises, when looking at it separately, the step of determining the compensation signal (cf. step 200) starting from information on the distortion signal portion, and the step of compensating and/or reducing the distortion signal portion when outputting the compensation signal 14*s* as the second sound signal. This means that this second step equals step 120.

Further embodiments will be discussed below referring to FIG. 2*a*. FIG. 2*a* illustrates the two loudspeaker groups 12 and 14 which emit the sound signals 12*e* (starting from the audio signal 12*s*) and 14*e* (starting from the control signal 14*s*) so that the signal 12*e*+14*e* free from distortions results in the case of superpositioning (cf. superposition function Z or reference numeral $f_{12e+14e}$). Z represents the complex radiation impedance. In principle, the radiation resistance in the frequency region of the signal 12*v* is decreased by the signal 14*e* and thus an emission of 12*v* in the far field is prevented.

The control signal 14*s* for controlling the second loudspeaker group 14 is generated by the signal synthesis means 17. There are different approaches of calculating the signal 14*s*.

In correspondence with a first variation, the input signal u or 12*s* is reproduced by the loudspeaker group 1 (cf. reference numeral 12) and results in a membrane velocity signal v or 12*e*. This signal 12*e* is subjected to signal analysis where the useful signal 12*s* is separated from the disturbing signal 12*v*. A signal analyzer 19 is used here which is optionally coupled to a microphone 21 or another sound receiver so that it can receive the signal 12*e* of the loudspeaker group 12. Alternatively, a different kind of signal reception may take place, like by a sensor at the membrane of the loudspeaker of the loudspeaker group 12 or by tapping the electrical signal of the loudspeaker group 12. This means that obtaining the output signal from the loudspeakers or loudspeaker group 1 (cf. reference numeral 12) can take place in different ways. Further examples are measuring the acceleration, velocity, deflection of the membrane, air-borne or structure-borne sound measurement or an electrical measurement at the loudspeaker terminals. The result of the signal analyzer 19 will be information on the disturbing signal or distortion signal 12*v*.

This information is fed to the signal synthesizer 12*v* which then processes the disturbing signal 12*v* to form a control signal c or 14*s*. Processing may, for example, comprise inverting. The disturbing signal 14*s* or *c* is then reproduced by the loudspeakers of the loudspeaker group 2 (i.e. reference numeral 14) so that the disturbing portion is reduced or eliminated completely in the sound field p or 16 by the loudspeakers or loudspeaker group 1 (i.e. reference numeral 12). Signal synthesis may, for example, be realized by inverting the disturbing signal while considering the transfer function of the compensation loudspeaker or the compensation of the loudspeaker group 2 (i.e. reference numeral 14).

In correspondence with further embodiments, the signal analyzer 19 is not necessary so that the signal synthesizer 17 obtains the disturbing signal 12*v*, or generally information on the disturbing signal 12*v*, by modelling or simulating the loudspeaker 12. In correspondence with the embodiment discussed here, the compensation means comprise, apart from the loudspeaker 14 of the second loudspeaker group, the signal synthesizer 17 and, as an alternative to the signal analyzer 19, a signal simulator (not illustrated). The signal simulator can simulate or predict the disturbing signal 12*v* starting from the signal 12*s* and information on the loudspeaker group 1 (i.e. reference numeral 12). Here, a useful output signal (membrane deflection, velocity, sound pressure, . . . ) is simulated/predicted in dependence on the input signal (voltage) and this prediction is analyzed as to its distortion portion.

Even when, in the above embodiments, it has been assumed that the loudspeaker group 1 reproduces only one audio signal 12*s*, the loudspeaker group 1 may also comprise a plurality of individual loudspeakers for different channels of a stereo application or surround sound application. Advantageously, the loudspeaker group 2 comprises the correspondingly associated loudspeakers. Here, the channels can be associated to different loudspeakers (spatially separate units) or also reproduce several channels using a loudspeaker (i.e. soundbar). Correspondingly, the loudspeaker group 2 is separated either into several individual loudspeakers or one multi-channel loudspeaker.

In correspondence with further embodiments, the loudspeaker group 1, but particularly also the loudspeaker group 2, may be configured to operate beamforming. When the loudspeaker group 2 is configured (operated) for beamforming, in correspondence with an advantageous variation, a loudspeaker system of the loudspeaker group 1 (comprising a plurality of loudspeakers, for example) may also be operated by means of beamforming. Compensation of an audio signal, reproduced by means of beamforming, by a single loudspeaker of the loudspeaker group 2 is also possible. Expressed differently, this means that, when using several loudspeakers anyway, a beamforming technology can also be used. In analogy, expressed the other way round: when using a beamforming technology, the compensation approach can also be applied using the number of the transducers.

All the embodiments mentioned above allow, when compared to known technology (Active Noise Control (or counter-noise with distortion noise) and/or Active Loudspeaker Control (or electrical (pre-)distortion of the loudspeaker signal), loading the distorted loudspeaker to a reduced extent. The background here is that no additional signal is fed to it. In addition, smaller power backup has to be provided in the amplifier channel for the distorting loudspeaker/loudspeaker grouping. In accordance with the invention, the non-linear behavior of membranes can also be compensated with no intrinsic drive (passive membrane) using an additional loudspeaker/loudspeaker grouping (or using the active membrane).

The method for compensating transducer non-linearities when compared to Active Noise Control systems will be discussed making reference to FIGS. 2*a* and 2*b*.

The schematic block circuit diagram and the signal flowchart of this method are represented in FIG. 2*a*. An audio signal, represented by a voltage signal, is applied to a loudspeaker. The transformation from voltage to membrane velocity is described by the linear complex transfer function Hlin. The non-linear transfer function H(x) characterizes the deflection-dependent non-linearities of the transducer. The measurement of the membrane velocity is fed to signal analysis which can separate the disturbing signal—i.e. the distortion products—from the useful signal. This disturbing signal is still present as a velocity signal. By means of the inverted linear transfer function H−1 lin, the velocity signal may be transferred again to a voltage signal. This time signal is inverted and fed to a second loudspeaker, the equalizing loudspeaker. This is where transformation from voltage to velocity takes place, illustrated by the transfer function Hlin. It is assumed that the modified disturbing signal has such a small amplitude that there is no non-linear behavior of the equalizing loudspeaker. Coupling the membrane movement to air is illustrated by the complex radiation impedance ZKo. The sound pressure disturbing signal of the first distortion loudspeaker is present in an inverted form in the sound pressure reproduced of the equalizing loudspeaker. In terms of physics, the real part of the radiation impedance is decreased by the equalizing loudspeaker, thereby decreasing coupling of the disturbing signal. The membrane velocity remains unchanged, but emits less disturbing sound.

This method borders on a sub-field of Active Noise Control (ANC), i.e. narrow-band Active Noise Control. Active Noise Control comprises electro-acoustically generating a sound field in order to eliminate an existing, but undesired sound field. Narrow-band Active Noise Control systems deal with regulating periodic disturbing signal as are frequently emitted by rotating mechanical elements, like motors or fans. Suppressing the disturbing sound is based on the principle of superpositioning; a control signal of equal amplitude but opposite phase is generated by an electroacoustic or electromechanical system and the sound emission thereof is combined with the sound field of the disturbing source. This results in an elimination of both sound fields.

The basic principle of a narrow-band ANC system is illustrated schematically in FIG. 2*b*. A disturbing source emits a periodic harmonic disturbing signal. A non-acoustic sensor records a synchronization signal which is used in a signal generator in order to synthesize a reference signal x(n). A digital filter generates, from the reference signal, the control signal y(n) which is reproduced via the control loudspeaker.

Optionally, an error microphone can be used, which measures the residual sound field and feeds the same to an adaptive algorithm as an error signal e(n). The same adapts the coefficients of the digital filter. When compared to the method of this paper presented, the following analogies can be found:

- the examinations of the method are limited to individual sine tones or harmonic narrow-band signals
- the membrane velocity is measured using a non-acoustic sensor
- signal analysis separates the disturbing signal from the useful signal and generates the reference signal
- filtering using the inverse transfer function Hlin and inverting the voltage signal generate the control signal.

A first loudspeaker is excited by a tonal signal. It is possible to adapt the amplitude and phase of the excitation signal of a second loudspeaker such that the sound pressure is eliminated directly in front of the membrane of the first loudspeaker. Equally, the first loudspeaker eliminates the sound pressure of the second loudspeaker. There is no active power done, only pressure compensation between the two loudspeakers takes place; an acoustic short-circuit is formed. The air between the two loudspeakers is shifted back and forth in an undirected manner, which is how a local sound pressure field forms between the loudspeaker membranes, but no sound pressure is emitted to the far field by decreasing the real part of the radiation impedance. The radiation impedance is frequency-dependent. The following examinations are restricted to individual sine tones. These are to represent the useful signal as a basic frequency. The distortion products are expressed by additional integer harmonics of the basic frequency. The disturbing signal is made up of the sum of harmonics. If the radiation impedance is decreased only in the frequency range above the basic frequency, only coupling of the harmonics will be prevented. In the ideal case, the resulting sound pressure signal is a signal which is in a linear relation to the audio signal or voltage signal.

Subsequently, using diagrams which are based on actual measurement data and not pure simulations, it will be discussed referring to FIGS. 3 to 5 how and how well the compensation means reduce disturbing signals or distortion signal portions, wherein this is illustrated by actual measurement data, and not by simulations.

Figure 3A:
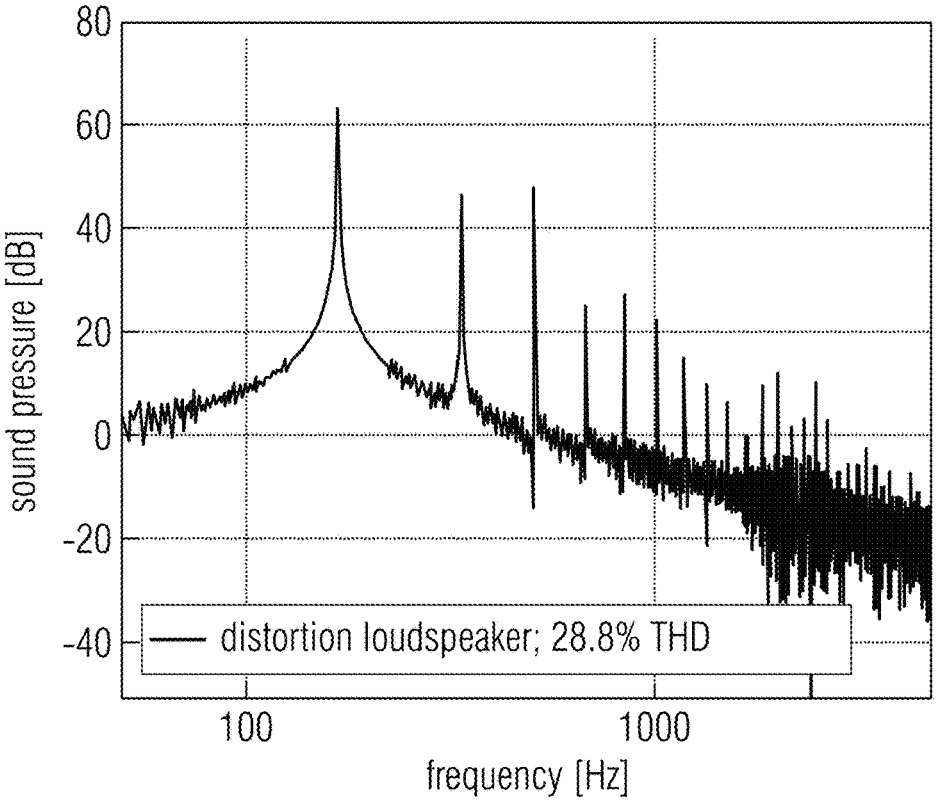
FIGS. 3*a, b* show schematic diagrams of amplitude spectra for illustrating the reduction of harmonic distortions while using the compensation means in correspondence with embodiments.
Figure 3B:
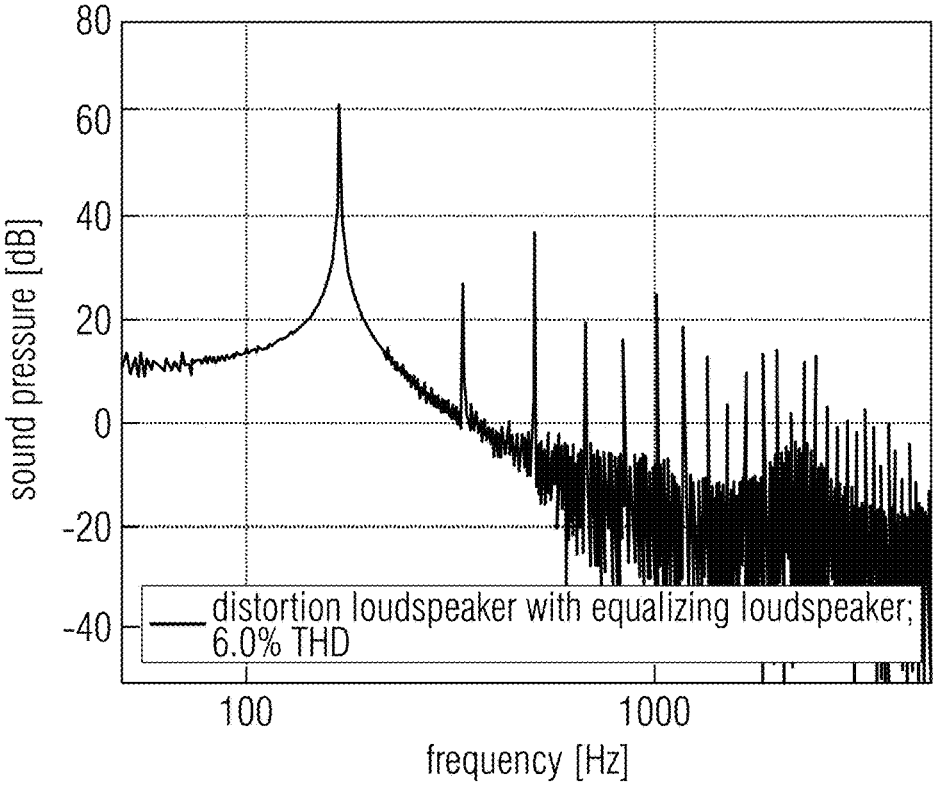

FIG. 3*a* shows the amplitude spectrum of a single loudspeaker with a sine excitation of, for example, 170 Hz. The amplitude spectrum of the distorted loudspeaker with the sine excitation (170 Hz) with a second loudspeaker using which a compensation signal is reproduced is illustrated in FIG. 3*b*. The combination of the two loudspeakers results in a reduction in harmonics (340 Hz, 510 Hz, 680 Hz, 850 Hz) from a THD of 28.8% (cf. FIG. 3*a*) to a THD of 6.0% (cf, FIG. 3*b*). Thus, it can be stated that the harmonic distortions (THD=total harmonic distortion) are reduced considerably.

Figure 4A:
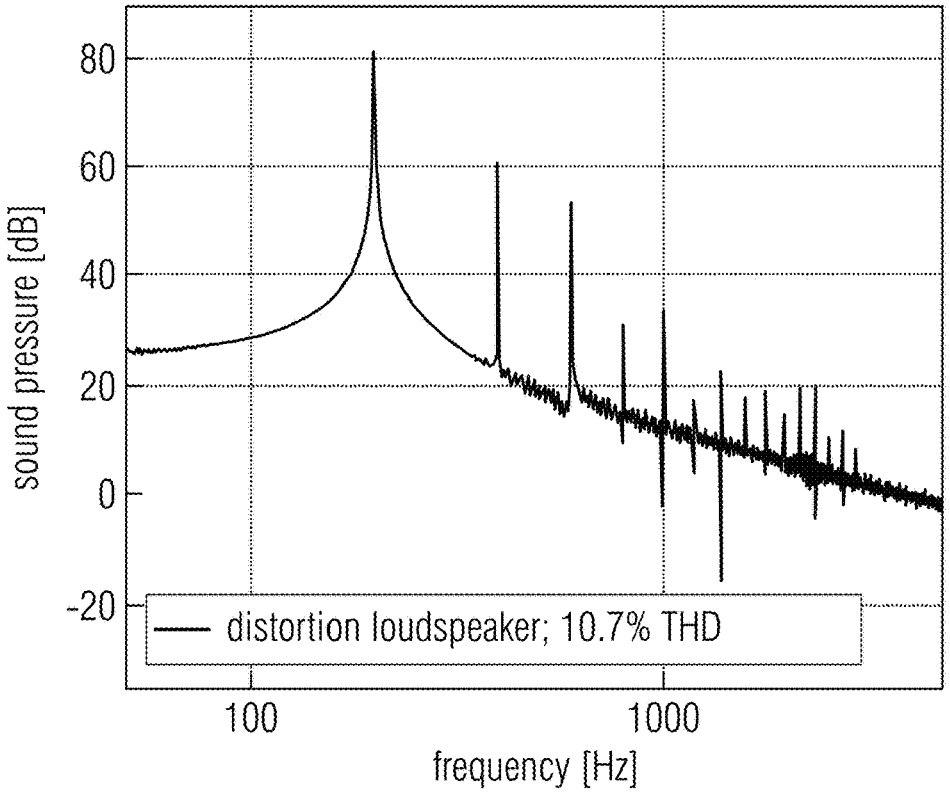
FIGS. 4*a, b* show schematic diagrams of amplitude spectra for illustrating the reduction of the harmonic distortions by compensation means in accordance with embodiments.
Figure 4B:
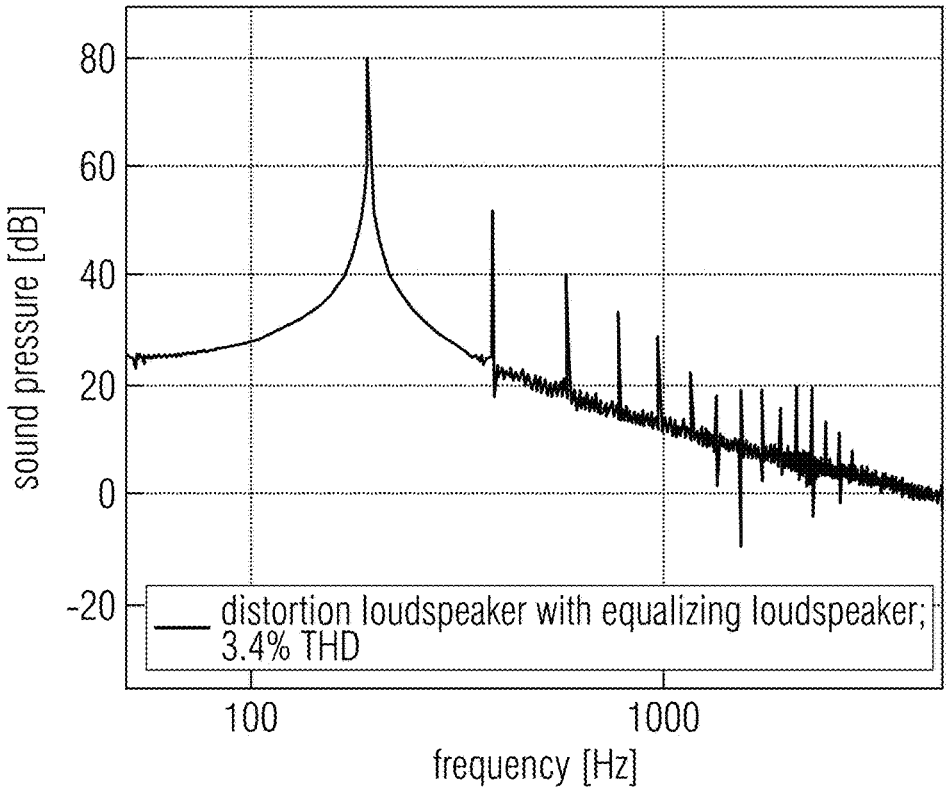

FIG. 4*a* shows an amplitude spectrum of an array of 12 separate loudspeakers with a sine excitation of, for example, 200 Hz. The resulting amplitude spectrum of the distorted loudspeaker array (i.e. reference numeral 12) with a sine excitation (200 Hz) with an additional thirteenth loudspeaker using which a compensation signal is reproduced is illustrated in FIG. 4*b*. As can be recognized, when combining the additional loudspeaker with the array, a significant reduction in harmonics (400 Hz, 600 Hz, 800 Hz and 1000 Hz) from a THD of 10.7% to a THD of 3.4% takes place. In the end, it can be stated that a significant equalization can be achieved even with an array having a plurality of separate loudspeakers or individual channels, using a single additional loudspeaker. The thirteen loudspeakers may be of the same type.

Background information: In the previous section, it has been shown that the THD of several loudspeakers in the array with individual sine tones can be reduced considerably by an equalization loudspeaker. The method will work best if/when the loudspeakers are located as close to one another as possible. The previous measurements were performed using a relatively high amplifier voltage so that the THD values were very big. In permanent operation, such high voltages might cause damage to the loudspeakers or decrease their lifetimes. In order to use the method in a realistic application, like in flat loudspeaker technology, a greater array configuration was set up. The same consists of twelve loudspeakers with an additional equalizing loudspeaker. The transducer D3E was chosen as the equalizing loudspeaker. The twelve distortion loudspeakers are located around the equalizing loudspeaker. The amplifier voltage was adapted such that the array of twelve sound transducers, with no equalizing loudspeaker, obtains a THD value of 10% at 200 Hz. This value is obtained by halving the previous voltage per individual transducer and represents a load for the transducer which it can withstand with no damage caused over a long period of operation. The equalizing signal for the transducer D3E was determined on the basis of the harmonic distortion of the membrane velocity of D2 with an identically reduced voltage and increased by 20·log (12)=21.6 dB, in order to equalize twelve transducers. In the main emission direction, the harmonic distortion of the loudspeaker array can be decreased by the equalizing loudspeaker from 10.7% to 3.4%. This corresponds to a reduction by 10 dB. The maximum distance between equalizing loudspeaker and distortion loudspeakers in this arrangement is 7.4 cm. The transducer distance has a decisive influence on the effectivity of the control method. With too great a transducer distance, depending on the listening place, different runtimes of distortion and equalizing loudspeakers will result. Correspondingly, higher-order harmonics can be reduced only to a poorer extent when compared to lower orders, due to their shorter wavelength. The THD as a sole quantity of evaluation is not sufficient since it represents only the sum of harmonics, but not the ratio among one another. Theoretically, it is even possible that the THD value decreases by the equalizing loudspeaker, but individual harmonics are amplified and consequently the sound pattern is deteriorated.

In order to examine the influence of the array extension in a future application, the spatial sound emission of the array of twelve loudspeakers with an equalizing loudspeaker in the horizontal 0° plain was examined. The sound pressure level of the second and third harmonics is reduced by about 10 dB by the equalizing loudspeaker, largely independently of the angle. However, the fourth harmonic exhibits a deviating behavior. Its sound pressure level seems not to be eliminated by the equalizing loudspeaker, but even increases slightly. This behavior, too, is largely independent of the measuring angle, a fact from which can be deduced that the correct phase angle needed for elimination has not been reached sufficiently precisely. Another indication of this is the fact that, even when equalizing an individual loudspeaker, the phase difference between equalizing and distortion loudspeaker deviates from the ideal value 180° by 42°. Since the fourth harmonic is weaker than the basic frequency by about 50 dB SPL, its influence on harmonic distortion is very small. The fifth harmonic shows that the method works with higher frequencies (in this case 1000 Hz) as well. However, its sound pressure level is no longer reduced by 10 dB, but only by roughly 5 dB on the axis. Towards the sides, the reduction is even smaller. The THD can be reduced by 10% at 0°. With a value deviating from 0°, the reduction remains largely the same with this dimension and frequency. This is a proof of the fact that the method may also be used sensibly for larger arrays, like, for example, in flat loudspeakers, for the frequency range considered and, with this setup, works largely independently of the angle.

The theoretical consideration of efficiency increase is to be pointed out here: Using the array examined made up of 12 loudspeakers, the THD at 200 Hz can be reduced from 10.7% to 3.4% by adding an equalizing loudspeaker. What follows is a theoretical estimation of how many loudspeakers are needed in an array with no additional equalizing loudspeaker in order to achieve the same sound pressure level with the same THD value. The array made up of twelve loudspeakers plus equalizing loudspeakers achieves, with an excitation of 200 Hz and a THD of 3.4%, a sound pressure level of 81.4 dB10 at a distance of 1.55 m. With no equalizing loudspeaker, the individual transducer generates a maximum of 53.4 dB SPL11 with the same distance and 3.4% THD. Consequently, the result with twelve transducers with no equalization is an overall sound pressure level of at most 53.4 dB+20·log(12) dB=75 dB. This value is 6.4 dB below the SPL achieved of the array with equalizing loudspeaker. In order to achieve an SPL of 81.4 dB with an array of identical loudspeakers with no equalizing loudspeakers, at least 10 (81.4−53.4)/20=25.1—i.e. 26—transducers are needed. Using harmonic distortion reduction with an additional equalizing loudspeaker allows generating, under the preconditions described, the same SPL with no increase in THD with 13 instead of 26 separate transducers. This corresponds to halving the separate loudspeakers used.

Figure 5A:
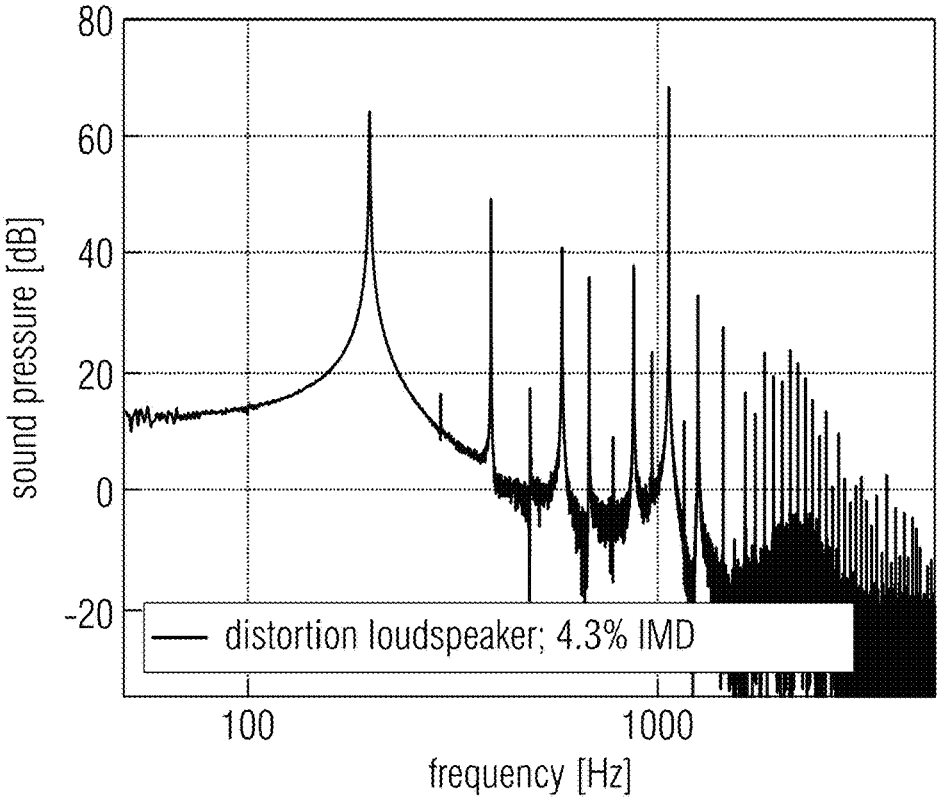
FIGS. 5*a, b* show schematic diagrams of amplitude spectra for illustrating the reduction of intermodulation distortions by compensation means in correspondence with embodiments.
Figure 5B:
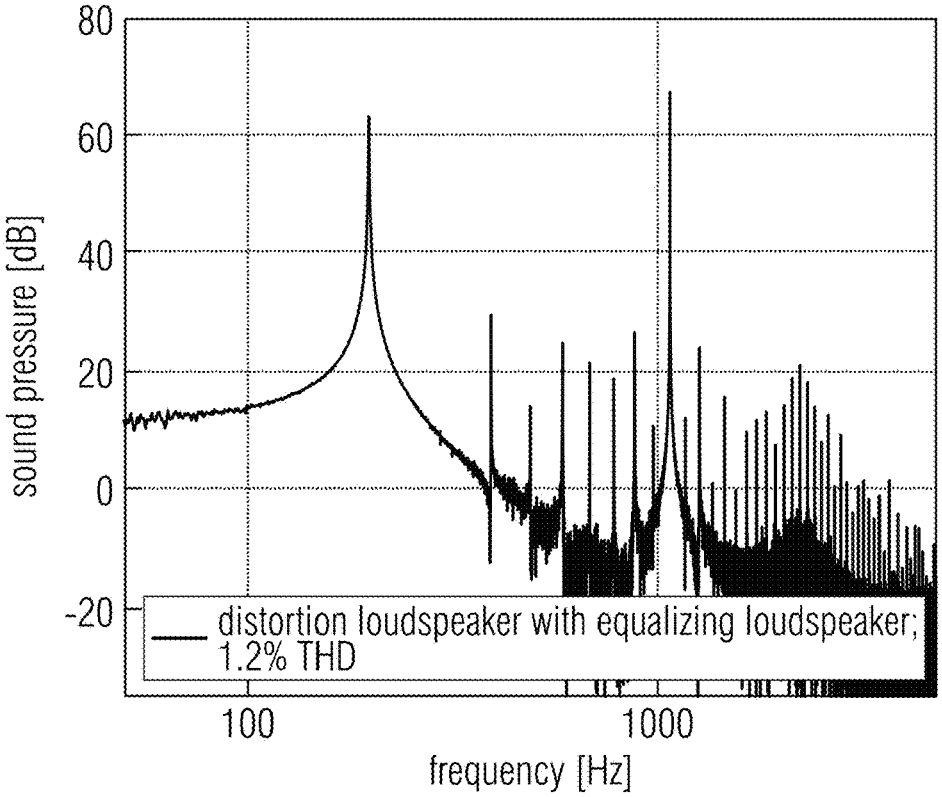

FIG. 5*a* shows a schematic diagram of an amplitude spectrum of an individual loudspeaker with two-tone sine excitation at 200 Hz and 5500 Hz, for example. The resulting amplitude spectrum of the individual loudspeaker with an additional compensation loudspeaker is illustrated in FIG. 5*b*. As can be recognized, with two sine excitation, too, using means for compensation causes a reduction of the intermodulation distortion from an IMD of 4.3% to an IMD of 1.2%.

Background information: In known technology, the control signal is fed to the excitation signal, which means that compensation of transducer non-linearities takes place directly at the respective loudspeaker. The array idea, as examined so far, is not used in known technology. For finally examining the effectivity of the compensation methods described, a comparison is to be made to known technology. The control signal calculated by velocity simulation is, as is the case in known technology, reproduced using the distortion loudspeaker. The table below indicates the values of THD reduction. The model-based reduction of the harmonic distortion on a transducer is similarly small as the model-based compensation with an additional equalizing loudspeaker. At 170 Hz and 200 Hz, only the second harmonic can be decreased. The third and fourth harmonics are even increased considerably by the wrong phase position, which results in a considerable distortion of the waveform in the time signal and a deteriorated reproduction quality. The examinations using the model-based control signals show that the loudspeaker model as taken from expert literature is too imprecise in order to cause a harmonic distortion reduction in the case of an excitation with discrete sine tones. Thus, with harmonic distortions, a reduction of 20% to 1-3% or an attenuation of at least 16 dB is achieved. Possibly, higher a compensation can be obtained despite the simple loudspeaker model, by adaptive tracking where the model parameters are updated continuously. The following table shows the THD of the sound velocity measured of the distortion loudspeaker D2z alone and together with the control signal, calculated on the basis of the velocity measurement, which was reproduced using the same transducer.

| | THD D2Z | THD D2Z + D2E | THD reduction |
|---|---|---|---|
| 170 Hz | 32.9% | 13.9% | 7.5 dB |
| 200 Hz | 25.5% | 7.5% | 10.6 dB |
| 300 Hz | 12.4% | 1.2% | 20.3 dB |

The control signal based on the simulated membrane velocity, despite being fed to the actual excitation signal as described in known technology, exhibits only a very small reduction in harmonic distortion. Finally, the control signal calculated by velocity measurement is to be reproduced using the distortion loudspeaker. In the above table, the THD values with and without control signal and the corresponding THD reduction are indicated. At first, it is to be mentioned that the harmonic distortion values at 170 Hz and 200 Hz and the compensation of the respective harmonic spectrum with no control signal differ slightly from the examination results, despite equal excitation. This can be attributed to the temporal distance between the respective measurements and rebuilding the measuring setup in the meantime and a corresponding slightly deviating microphone position. It is also to be mentioned that the second harmonic is reduced less at 170 Hz and 200 Hz when the control signal is reproduced using the same transducer D2Z. At 300 Hz, the reduction performance of both methods is nearly identical. The smaller reduction at 170 Hz and 200 Hz when the control signal is reproduced using the same transducer, can be attributed to the high deflection of the membrane with lower frequencies. It can also be deduced that the miniature transducer examined achieves higher a membrane deflection at 170 Hz and 200 H7 than at 300 Hz.

This means that the transducer generates higher non-linear distortions by the higher deflection, which can be recognized from the increasing harmonic distortion. By adding the control signal to the excitation signal, depending on the phase position of the harmonics, peaks will result in the time signal which cause even higher a deflection and form new distortion products the compensation of which is not provided for by the actual control signal. Expressed differently, the transducer, when excited with no equalization, already reaches its deflection limit with such high harmonic distortions and has no longer sufficient capacities or margin in order to precisely reproduce the additional control signal. With a tone at 300 Hz which the transducer has generated with less deflection, there is still a sufficient deflection backup in order to simulate the equalizing signal sufficiently. The equalizing method with an additional equalizing loudspeaker is sensible as soon as the distortion a loudspeaker is operated already close to its deflection limit. In this case, the control signal can no longer be reproduced sufficiently precisely using the same distortion loudspeaker. When the distortion loudspeaker operates in a less non-linear range, i.e. with less deflection, the novel method is not of advantage compared to known technology. In this case, both methods are able to reduce distortion products. When equalizing using an additional loudspeaker, the influence of runtime differences with higher frequencies may be of disadvantage compared to known technology.

As the metrological evaluation of the method has shown, the values for harmonic distortion (THD) can be reduced by up to 21 dB. In addition, the harmonic distortion behavior of a transducer group of twelve loudspeakers can be improved considerably by an equalizing loudspeaker.

Applications for the equalization as discussed above are as follows: loudspeakers/loudspeaker groups, sound transducers, actuators, closed loudspeakers, ventilated loudspeakers, loudspeakers having one/several active and one/several passive membranes, structure-borne sound exciters, bass shakers, ultrasound transducers, exciters, sound sources of every kind. The term "loudspeaker" as mentioned in the text can generally be replaced by the terms listed here.

Although some aspects have been described in the context of an apparatus, it is clear that these aspects also represent a description of the corresponding method, such that a block or device of an apparatus also corresponds to a respective method step or a feature of a method step. Analogously, aspects described in the context of or as a method step also represent a description of a corresponding block or detail or feature of a corresponding apparatus. Some or all of the method steps may be executed by (or using) a hardware apparatus, like, for example, a microprocessor, programmable computer or electronic circuit. In some embodiments, some or several of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray disc, a CD, an ROM, a PROM, an EPROM, an EEPROM or a FLASH memory, a hard drive or another magnetic or optical memory having electronically readable control signals stored thereon, which cooperate or are capable of cooperating with a programmable computer system such that the respective method is performed. Therefore, the digital storage medium may be computer-readable.

Some embodiments according to the invention include a data carrier comprising electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer.

The program code may, for example, be stored on a machine-readable carrier.

Other embodiments comprise the computer program for performing one of the methods described herein, wherein the computer program is stored on a machine-readable carrier.

In other words, an embodiment of the inventive method is, therefore, a computer program comprising a program code for performing one of the methods described herein, when the computer program runs on a computer.

A further embodiment of the inventive methods is, therefore, a data carrier (or a digital storage medium or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may, for example, be configured to be transferred via a data communication connection, for example via the Internet.

A further embodiment comprises processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer a computer program for performing at least one of the methods described herein to a receiver. The transfer can be performed electronically or optically. The receiver may, for example, be a computer, a mobile device, a memory device or the like. The apparatus or system may, for example, comprise a file server for transferring the computer program to the receiver.

In some embodiments, a programmable logic device (for example a field programmable gate array, FPGA) may be used to perform some or all of the functionalities of the methods described herein. In some embodiments, a field programmable gate array may cooperate with a microprocessor in order to perform one of the methods described herein. Generally, in some embodiments, the methods may be performed by any hardware apparatus. This can be a universally applicable hardware, such as a computer processor (CPU), or hardware specific for the method, such as ASIC.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. A compensator for a loudspeaker system comprising a first loudspeaker group comprising at least one sound transducer, the first loudspeaker group being configured to generate a first sound signal based on an audio signal, the first sound signal comprising a useful signal portion and a distortion signal portion, the compensator comprising:

a second loudspeaker group comprising at least one sound transducer, the second loudspeaker group being configured to generate a second sound signal based on a compensation signal, the second sound signal compensating and/or reducing the distortion signal portion when superimposed with the first sound signal;

wherein the compensator comprises a calculating unit comprising a signal synthesizer configured to generate the compensation signal starting from information on the distortion signal portion; and wherein the calculating unit comprises a signal analyzer configured to analyze the first sound signal relative to the useful signal portion and the distortion signal portion and to extract the information on the distortion signal portion;

wherein the signal synthesizer is configured to invert the extracted distortion signal portion in order to acquire the compensation signal.

2. A loudspeaker system comprising:

a first loudspeaker group comprising at least one sound transducer, the first loudspeaker group being configured to generate a first sound signal based on an audio signal, the first sound signal comprising a useful signal portion and a distortion signal portion; and a second loudspeaker group comprising at least one sound transducer, the second loudspeaker group being configured to generate a second sound signal based on a compensation signal, the second sound signal compensating and/or reducing the distortion signal portion when superimposed with the first sound signal;

wherein the loudspeaker system comprises a calculating unit comprising a signal synthesizer configured to generate the compensation signal starting from information on the distortion signal portion; and wherein the calculating unit comprises a signal analyzer configured to analyze the first sound signal relative to the useful signal portion and the distortion signal portion and to extract the information on the distortion signal portion;

wherein the signal synthesizer is configured to invert the extracted distortion signal portion in order to acquire the compensation signal.

3. The loudspeaker system in accordance with claim 2, wherein superpositioning of the second sound signal and the first sound signal takes place in a sound field generated in space.

4. The loudspeaker system in accordance with claim 2, wherein the at least one sound transducer of the second loudspeaker group or the second loudspeaker group is oriented relative to a sound field of the first loudspeaker group or a listening position belonging to the first loudspeaker group.

5. The loudspeaker system in accordance with claim 2, wherein the first loudspeaker group comprises at least one passive sound transducer.

6. The loudspeaker system in accordance with claim 2, wherein the first loudspeaker group comprises a plurality of independent sound transducers for reproducing a stereo sound field and/or a surround sound field.

7. The loudspeaker system in accordance with claim 3, wherein the first loudspeaker group is spaced apart from the second loudspeaker group at a distance of at most 3 m or, advantageously, at most 1 m so that superpositioning takes place in the nearfield of the first loudspeaker group.

8. The loudspeaker system in accordance with claim 2, wherein the signal analyzer for analyzing receives the audio signal and compares the same to the first sound signal.

9. The loudspeaker system in accordance with claim 2, wherein the information on the distortion signal portion comprises the distortion signal portion isolated from the useful signal portion.

10. The loudspeaker system in accordance with claim 2, wherein the signal synthesizer is configured to determine the compensation signal while considering the transfer function of the at least one sound transducer of the second loudspeaker group.

11. The loudspeaker system in accordance with claim 2, wherein the signal analyzer comprises a measurer for measuring the acceleration, velocity and/or deflection of the membrane or a measurer for measuring the air-borne or structure-borne sound and/or a microphone and/or a processor for electrical measurements at the loudspeaker terminals.

12. The loudspeaker system in accordance with claim 2, wherein the signal analyzer comprises a processor for modeling and simulating the useful signal portion and distortion signal portion.

13. The loudspeaker system in accordance with claim 2, wherein the second loudspeaker group comprises a plurality of independent sound transducers and is configured to emit the second sound signal by means of beamforming.

14. The loudspeaker system in accordance with claim 2, wherein the second loudspeaker group comprises a plurality of independent sound transducers and is configured to generate several second sound signals for several sound fields.

15. A calculating unit comprising a signal synthesizer, wherein the signal synthesizer is configured to determine a compensation signal starting from information on a distortion signal portion which, together with a useful signal portion is comprised by a first sound signal generated by a first loudspeaker group on the basis of an audio signal, wherein the compensation signal is suitable to compensate and/or reduce the distortion signal portion when outputting the same as a second sound signal via a second loudspeaker group by superpositioning with the first sound signal;

wherein the signal synthesizer is configured to generate the compensation signal starting from information on the distortion signal portion; and wherein the calculating unit comprises a signal analyzer configured to analyze the first sound signal relative to the useful signal portion and the distortion signal portion and to extract the information on the distortion signal portion;

wherein the signal synthesizer is configured to invert the extracted distortion signal portion in order to acquire the compensation signal.

16. A method for generating a useful signal portion, comprising:

outputting, using a first loudspeaker group comprising at least one sound transducer, a first sound signal based on an audio output signal, the first sound signal comprising a useful signal portion and a distortion signal portion;

determining a compensation signal starting from information on a distortion signal portion which, together with a useful signal portion, is comprised by a first sound signal; and outputting, using a second loudspeaker group comprising at least one sound transducer, a second sound signal based on the compensation signal, the second sound signal compensating and/or reducing the distortion signal portion when superimposed with the first sound signal;

wherein determining comprises generating the compensation signal starting from information on the distortion signal portion, analyzing the first sound signal relative to the useful signal portion and the distortion signal portion, extracting the information on the distortion signal portion and inverting the extracted distortion signal portion in order to acquire the compensation signal.

17. A method for calculating a compensation signal, comprising:

determining a compensation signal starting from information on a distortion signal portion which, together with a useful signal portion, is comprised by a first sound signal generated by a first loudspeaker group on the basis of an audio signal; and compensating and/or reducing the distortion signal portion when outputting the compensation signal as a second sound signal via a second loudspeaker group by superpositioning with the first sound signal;

wherein determining comprises generating the compensation signal starting from information on the distortion signal portion, analyzing the first sound signal relative to the useful signal portion and the distortion signal portion, extracting the information on the distortion signal portion and inverting the extracted distortion signal portion in order to acquire the compensation signal.

18. A non-transitory digital storage medium having stored thereon a computer program for performing a method for generating a useful signal portion, comprising:

outputting, using a first loudspeaker group comprising at least one sound transducer, a first sound signal based on an audio output signal, the first sound signal comprising a useful signal portion and a distortion signal portion;

determining a compensation signal starting from information on a distortion signal portion which, together with a useful signal portion, is comprised by a first sound signal; and outputting, using a second loudspeaker group comprising at least one sound transducer, a second sound signal based on the compensation signal, the second sound signal compensating and/or reducing the distortion signal portion when superimposed with the first sound signal;

wherein determining comprises generating the compensation signal starting from information on the distortion signal portion, analyzing the first sound signal relative to the useful signal portion and the distortion signal portion, extracting the information on the distortion signal portion and inverting the extracted distortion signal portion in order to acquire the compensation signal;

when said computer program is run by a computer.

19. A non-transitory digital storage medium having stored thereon a computer program for performing a method for calculating a compensation signal, comprising:

determining a compensation signal starting from information on a distortion signal portion which, together with a useful signal portion, is comprised by a first sound signal generated by a first loudspeaker group on the basis of an audio signal; and compensating and/or reducing the distortion signal portion when outputting the compensation signal as a second sound signal via a second loudspeaker group by superpositioning with the first sound signal;

wherein determining comprises generating the compensation signal starting from information on the distortion signal portion, analyzing the first sound signal relative to the useful signal portion and the distortion signal portion, extracting the information on the distortion signal portion and inverting the extracted distortion signal portion in order to acquire the compensation signal;

when said computer program is run by a computer.

* * * * *